US009639026B2

(12) United States Patent
Taguchi

(10) Patent No.: US 9,639,026 B2
(45) Date of Patent: May 2, 2017

(54) CARTRIDGE WITH TRANSMISSION GEAR AND TOOTHLESS GEAR

(71) Applicant: Brother Kogyo Kabushiki Kaisha, Nagoya-shi, Aichi-ken (JP)

(72) Inventor: Kazuna Taguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,801

(22) Filed: Mar. 27, 2015

(65) Prior Publication Data

US 2015/0277282 A1 Oct. 1, 2015

(30) Foreign Application Priority Data

Mar. 31, 2014 (JP) ..... 2014-074725

(51) Int. Cl.
*G03G 15/08* (2006.01)
*G03G 21/18* (2006.01)

(52) U.S. Cl.
CPC ..... *G03G 15/0865* (2013.01); *G03G 21/1857* (2013.01); *G03G 21/1896* (2013.01); *G03G 2221/1657* (2013.01)

(58) Field of Classification Search
CPC ..... G03G 21/1896; G03G 2221/1892
USPC ..... 399/12
See application file for complete search history.

(56) References Cited

U.S. PATENT DOCUMENTS 4,974,020 A 11/1990 Takamatsu et al.
5,053,816 A 10/1991 Takahashi
5,489,976 A 2/1996 Ichikawa
5,495,323 A 2/1996 Meetze, Jr.
5,495,327 A 2/1996 Inomata
5,640,651 A 6/1997 Katoh et al.
5,649,264 A 7/1997 Domon et al.
5,970,293 A 10/1999 Huang
6,088,561 A 7/2000 Kawamura et al.
(Continued)

FOREIGN PATENT DOCUMENTS

AU 2010281279 B2 2/2014
CN 1445624 A 10/2003
(Continued)

OTHER PUBLICATIONS

Feb. 27, 2014—(KR) Notice of Preliminary Rejection—App 10-2012-7028457.

(Continued)

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

A cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to rotate from a first state where the driving force from the driving receiving part is transmitted to the rotary member to a second state where the transmission of the driving force from the driving receiving part to the rotary member is released, and then rotate from the second state to the first state.

27 Claims, 23 Drawing Sheets

(56) References Cited

U.S. PATENT DOCUMENTS 6,154,619 A 11/2000 Boockholdt et al.
6,714,224 B2 3/2004 Yamanaka et al.
6,792,217 B2 9/2004 Nishino et al.
6,823,160 B2 11/2004 Okabe
6,829,465 B2 12/2004 Yamanaka et al.
6,903,759 B2 6/2005 Yamanaka et al.
6,909,866 B2 6/2005 Kawai
6,920,303 B2 7/2005 Yamanaka et al.
7,116,919 B2 10/2006 Ishii
7,130,551 B2 10/2006 Kobayashi
7,418,214 B2 8/2008 Yoshida et al.
7,463,834 B2 12/2008 Takagi et al.
7,509,075 B2 3/2009 Hayakawa
7,512,347 B2 3/2009 Suzuki et al.
7,536,117 B2 5/2009 Kishi
7,613,414 B2 11/2009 Kamimura
7,643,777 B2 1/2010 Matsumoto et al.
7,756,426 B2 7/2010 Kamimura
7,933,536 B2 4/2011 Ogawa
7,953,330 B2 5/2011 Ishikawa
8,010,026 B2 8/2011 Kobayashi et al.
RE42,796 E 10/2011 Ishii
8,090,272 B2 1/2012 Ishikawa
8,099,025 B2 1/2012 Ishikake
8,126,366 B2 2/2012 Hattori
8,417,130 B2 4/2013 Hashimoto
8,463,145 B2 6/2013 Ukai et al.
8,583,009 B2 11/2013 Takagi
8,600,244 B2 12/2013 Hashimoto
8,620,180 B2 12/2013 Shiraki et al.
8,666,293 B2 3/2014 Mushika et al.
8,744,288 B2 6/2014 Shinoya et al.
8,761,643 B2 6/2014 Mushika et al.
8,849,133 B2 9/2014 Itabashi et al.
8,867,932 B2 10/2014 Ukai et al.
8,948,617 B2 2/2015 Shiraki et al.
8,948,661 B2 2/2015 Mushika et al.
9,195,207 B2 11/2015 Itabashi
9,207,567 B2 12/2015 Mushika et al.
2003/0185579 A1 10/2003 Nishino et al.
2003/0185594 A1 10/2003 Okabe
2003/0215265 A1 11/2003 Kawai
2006/0034625 A1 2/2006 Kajikawa
2006/0104670 A1 5/2006 Nishitani et al.
2006/0165423 A1 7/2006 Nishitani et al.
2006/0171737 A1 8/2006 Nishimura et al.
2006/0193643 A1 8/2006 Takagi et al.
2006/0193646 A1 8/2006 Suzuki et al.
2006/0245787 A1 11/2006 Ito et al.
2007/0031158 A1* 2/2007 Kamimura ..... G03G 15/553 399/12
2007/0041747 A1 2/2007 Kim et al.
2007/0059018 A1 3/2007 Tokuda
2007/0059038 A1 3/2007 Shiraki
2007/0077101 A1 4/2007 Tamura et al.
2007/0122165 A1 5/2007 Igarashi et al.
2007/0140709 A1 6/2007 Yoshida et al.
2007/0140725 A1 6/2007 Kamimura
2007/0253748 A1 11/2007 Matsumoto et al.
2008/0080904 A1 4/2008 Murayama et al.
2008/0205911 A1 8/2008 Ishikawa et al.
2008/0205928 A1 8/2008 Ishikawa
2008/0205931 A1 8/2008 Ishikawa
2008/0223173 A1 9/2008 Ishikawa
2008/0317509 A1 12/2008 Mori
2009/0000423 A1* 1/2009 Ishikawa ..... G03G 15/0875 74/606 R
2009/0052911 A1 2/2009 Richey et al.
2009/0084210 A1 4/2009 Tsukada et al.
2009/0169247 A1 7/2009 Hattori
2009/0257782 A1 10/2009 Ishikake
2009/0269085 A1 10/2009 Ukai
2009/0269086 A1 10/2009 Mikuni
2009/0285604 A1 11/2009 Nakajima
2009/0297226 A1 12/2009 Nagashima et al.
2010/0054763 A1 3/2010 Tomiyori et al.
2010/0209144 A1 8/2010 Nieda
2011/0023368 A1 2/2011 Mizutani et al.
2011/0038649 A1 2/2011 Miyabe et al.
2011/0081163 A1 4/2011 Lee
2011/0123231 A1 5/2011 Ozawa et al.
2011/0236062 A1 9/2011 Takagi
2011/0236065 A1 9/2011 Takagi
2011/0236066 A1 9/2011 Takagi
2011/0243578 A1 10/2011 Ukai et al.
2012/0014713 A1 1/2012 Murakami et al.
2012/0051795 A1 3/2012 Mushika et al.
2012/0057905 A1 3/2012 Itabashi
2012/0134688 A1 5/2012 Hashimoto
2012/0148297 A1 6/2012 Peng et al.
2012/0177398 A1 7/2012 Takigawa
2012/0243882 A1 9/2012 Carot
2012/0251165 A1 10/2012 Mushika et al.
2012/0251216 A1 10/2012 Mushika
2012/0321345 A1 12/2012 Shinoya et al.
2013/0051813 A1 2/2013 Itabashi et al.
2013/0051814 A1 2/2013 Itabashi et al.
2013/0051815 A1 2/2013 Itabashi et al.
2013/0051816 A1 2/2013 Itabashi
2013/0051833 A1 2/2013 Itabashi et al.
2013/0084083 A1 4/2013 Itabashi et al.
2013/0136460 A1 5/2013 Shiraki et al.
2013/0170844 A1 7/2013 Itabashi
2013/0170845 A1 7/2013 Itabashi
2013/0259528 A1 10/2013 Yamamoto
2013/0272724 A1 10/2013 Ukai et al.
2014/0020489 A1* 1/2014 Nozaki ..... F16H 3/20 74/404
2014/0086638 A1 3/2014 Sato
2014/0169835 A1 6/2014 Nakajima
2014/0219690 A1 8/2014 Li et al.
2014/0294403 A1 10/2014 Shimizu
2014/0341617 A1 11/2014 Mushika et al.
2014/0363189 A1 12/2014 Hashimoto et al.
2014/0376968 A1 12/2014 Yamamoto et al.
2015/0000443 A1 1/2015 Shimizu
2015/0003844 A1 1/2015 Ukai et al.
2015/0005134 A1 1/2015 Shimizu
2015/0010334 A1 1/2015 Nakajima
2015/0037071 A1 2/2015 Yamamoto
2015/0043944 A1 2/2015 Yamamoto
2015/0104222 A1 4/2015 Mushika et al.
2015/0117873 A1 4/2015 Mori et al.
2015/0117906 A1 4/2015 Mori
2015/0153675 A1 6/2015 Itabashi et al.

FOREIGN PATENT DOCUMENTS

CN 1828447 A 9/2006
CN 1288515 C 12/2006
CN 2884266 Y 3/2007
CN 1983078 A 6/2007
CN 101063855 A 10/2007
CN 200962188 Y 10/2007
CN 101256379 A 9/2008
CN 101295157 A 10/2008
CN 201170840 Y 12/2008
CN 100476636 C 4/2009
CN 201222170 Y 4/2009
CN 101625537 B 1/2010
CN 201402371 Y 2/2010
CN 201464807 U 5/2010
CN 201489284 U 5/2010
CN 202102251 U 1/2012
CN 202472249 U 10/2012
CN 102799090 A 11/2012
CN 202649679 U 1/2013
CN 203673223 U 6/2014
EP 0838733 A2 4/1998
EP 1696278 A2 8/2006
EP 1696278 A3 8/2006
EP 1965268 A1 9/2008
EP 1965274 A2 9/2008
EP 1995644 A2 11/2008

(56) References Cited

FOREIGN PATENT DOCUMENTS

| | | | |
|---|---|---|---|
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S5323696 | | 2/1978 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Machine translation of JP 2006-235236 dated Jan. 9, 2014.
Jan. 5, 2012—(JP) Decision of Patent Grant—App 2010-083408.
Apr. 26, 2011—(WO) International Search Report (JPO)—App PCT/JP2011/057946.
Nov. 12, 2014—(US) Non-Final Office Action—U.S. Appl. No. 14/485,462.
Dec. 31, 2014—(CN) Notification of First Office Action—App 201310175410.5, Eng Tran.
Mar. 20, 2015—(US) Final Office Action—U.S. Appl. No. 14/485,462.
Mar. 27, 2015—(US) Co-pending U.S. Appl. No. 14/670,502.
Mar. 27, 2015—(US) Co-pending U.S. Appl. No. 14/670,676.
Decision to Grant a Patent issued in corresponding Japanese Patent Application No. 2010-193204 dated Sep. 18, 2012.
Notice of Reasons for Rejection issued in Japanese Patent Application No. 2012-229560 mailed Feb. 19, 2013.
Machine translation of JP 07-281519A dated May 2, 2013.
Machine translation of JP 10-031382A dated May 1, 2013.
Notice of Allowance received in U.S. Appl. No. 13/222,096 mailed Oct. 16, 2013.
Office Action received in related Chinese Patent Application No. 201110251898.6 mailed Oct. 15, 2013.
Notification of the First Office Action with Search Report issued in corresponding Chinese Patent Application No. 201110251898.6 dated Dec. 11, 2012.
Notice of Reasons for Rejection issued in corresponding Japanese Patent Application 2010-193204 mailed Jun. 26, 2012.
Notice of Allowance issued in corresponding U.S. Appl. No. 14/154,521 mailed Feb. 10, 2014.
Sep. 19, 2014—(US) Notice of Allowance—U.S. Appl. No. 14/275,251.
Mar. 19, 2015—(US) Non-Final Office Action—U.S. Appl. No. 14/577,396.
Co-pending U.S. Appl. No. 14/316,959, filed Jun. 27, 2014.
Co-Pending U.S. Appl. No. 14/316,971, filed Jun. 27, 2014.
Apr. 6, 2015—(US) Non-Final Office Action—U.S. Appl. No. 14/316,959.
Apr. 21, 2015—(EP) Extended Search Report—App 14173865.8.
May 8, 2015—Ex Parte Quayle—U.S. Appl. No. 14/316,971.
May 8, 2015—(US) Ex Parte Quayle—U.S. Appl. No. 14/316,971.
Mar. 3, 2015—(CN) Notification of First Office Action—App 201310175264.6, Eng Tran.
Mar. 3, 2015—(CN) Notification of First Office Action—App 201310175229.4, Eng Tran.
Sep. 17, 2015—(EP) Office Action—App 11160291.8.
Oct. 19, 2015—(US) Non-Final Office Action—U.S. Appl. No. 14/611,393.
Oct. 28, 2015—(US) Notice of Allowance—U.S. Appl. No. 14/316,959.
Nov. 27, 2015—(US) Non-Final Office Action—U.S. Appl. No. 14/670,502.
Dec. 14, 2015—(US) Non-Final Office Action—U.S. Appl. No. 14/926,345.
Dec. 17, 2015—(US) Non-Final Office Action—U.S. Appl. No. 14/670,676.

(56) References Cited

OTHER PUBLICATIONS

Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP ) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Feb. 25, 2016—(US) Non-Final Office Action—U.S. Appl. No. 14/316,959.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
Aug. 21, 2015 (EP) Extended EP Search Report—App. No. 15161258.7.
Aug. 20, 2015—(EP) Extended EP Search Report in App No. 15161221.5.
Apr. 14, 2014 (US) Non-Final Office Action in U.S. Appl. No. 13/628,492.
Sep. 23, 2014—(US) Notice of Allowance—U.S. Appl. No. 13/628,492.
Apr. 15, 2015—(US) Notice of Allowance—U.S. Appl. No. 14/529,221.
Aug. 4, 2015—(US) Notice of Allowance—U.S. Appl. No. 14/577,396.
Aug. 25, 2015—(US) Non-Final Office Action—U.S. Appl. No. 14/671,413.
Jul. 22, 2015—(US) Non-Final Office Action—U.S. Appl. No. 14/316,971.
May 18, 2015—(US) Non-Final Office Action—U.S. Appl. No. 14/611,393.
Sep. 17, 2015—(EP) Office Action—App 11179283.4.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 30, 2015—(US) Non-Final Office Action—U.S. Appl. No. 14/670,522.
Sep. 16, 2015—(US) Notice of Allowance—U.S. Appl. No. 14/485,462.
Apr. 12, 2016—(US) Notice of Allowance—U.S. Appl. No. 14/611,393.
Mar. 29, 2016—(US) Notice of Allowance—U.S. Appl. No. 14/485,462.
Apr. 14, 2016—(US) Notice of Allowance—U.S. Appl. No. 14/670,522.
Feb. 17, 2016—(US) Notice of Allowance—U.S. Appl. No. 14/671,413.
Apr. 1, 2016—(US) Notice of Allowance—U.S. Appl. No. 14/926,345.
Feb. 18, 2016—(US) Notice of Allowance—U.S. Appl. No. 14/529,221.
Feb. 2, 2016—(US) Notice of Allowance—U.S. Appl. No. 14/670,516.
Mar. 4, 2016—(US) Notice of Allowance—U.S. Appl. No. 14/491,157.
May 27, 2016—(US) Notice of Allowance—U.S. Appl. No. 14/671,413.
May 24, 2016—(EP) Communication—App 12157679.7.
Sep. 14, 2015—(EP) Communication—App 12157679.7.
Jun. 10, 2016—(US) Notice of Allowance—U.S. Appl. No. 14/316,971.
Apr. 16, 2013 (JP) Notice of Allowance—App. 2011100507.
Jun. 22, 2016—(US) Notice of Allowance—U.S. Appl. No. 14/529,221.
Jun. 22, 2016—(US) Notice of Allowance—U.S. Appl. No. 14/670,516.
Jul. 16, 2012—(EP) Search Report 12157679.7.
Jun. 17, 2016—(US) Notice of Allowance—U.S. Appl. No. 14/491,157.
Sep. 11, 2015—(EP) Communication—App 12157690.4.
Jun. 17, 2016—(US) Notice of Allowance—U.S. Appl. No. 14/926,345.
May 24, 2016—(EP) Communication—App 12157690.4.
Feb. 17, 2015 (JP) Notice of Allowance—App. 2011078637.
May 11, 2016—(EP) Communication—App 12161226.1.
Jun. 29, 2016—(US) Notice of Allowance—U.S. Appl. No. 14/611,393.
Jul. 11, 2016—(US) Non-Final Office Action—U.S. Appl. No. 14/670,502.
May 11, 2016—(EP) Communication—App 1261226.1.
Jul. 16, 2016—(EP) Search Report 12157679.7.
Jul. 14, 2016—(US) Notice of Allowance—U.S. Appl. No. 14/670,676.
Jul. 15, 2016—(US) Notice of Allowance—U.S. Appl. No. 14/670,522.
Aug. 1, 2016—(US) Notice of Allowance—U.S. Appl. No. 14/670,516.
Aug. 9, 2016—(US) Notice of Allowance—U.S. Appl. No. 15/079,829.
Sep. 12, 2016—(US) Notice of Allowance—U.S. Appl. No. 14/589,696.
Nov. 22, 2016—(JP) Office Action—App 2013137422—Eng Tran.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

* cited by examiner

CARTRIDGE WITH TRANSMISSION GEAR AND TOOTHLESS GEAR

CROSS-REFERENCE TO RELATED APPLICATIONS

This application claims priority from Japanese Patent Application No. 2014-074725 filed on Mar. 31, 2014, the entire contents of which are incorporated herein by reference.

TECHNICAL FIELD

Aspects of the disclosure relate to a cartridge configured to be mounted to an electrophotographic image forming apparatus.

BACKGROUND

As an electrophotographic printer, a printer to which a cartridge accommodating therein developer can be detachably mounted is known.

In the known printer, when a used cartridge is replaced with an unused cartridge, it is necessary to enable the printer to recognize that the unused cartridge has been mounted.

SUMMARY

It is therefore an object of the disclosure to provide a cartridge capable of enabling an external device to recognize that an unused cartridge has been mounted.

According to an aspect of the disclosure, there is provided a cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to rotate from a first state where the driving force from the driving receiving part is transmitted to the rotary member to a second state where the transmission of the driving force from the driving receiving part to the rotary member is released, and then rotate from the second state to the first state.

According to another aspect of the disclosure, there is provided a cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to temporarily stop between a start of the rotation and an end of the rotation.

According to another aspect of the disclosure, there is provided a cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to start the rotation by the driving force transmitted from the driving receiving part, stop the rotation after the starting of the rotation, and resume the rotation after the stopping of the rotation.

DETAILED DESCRIPTION

1. Outline of Developing Cartridge

Figure 1:
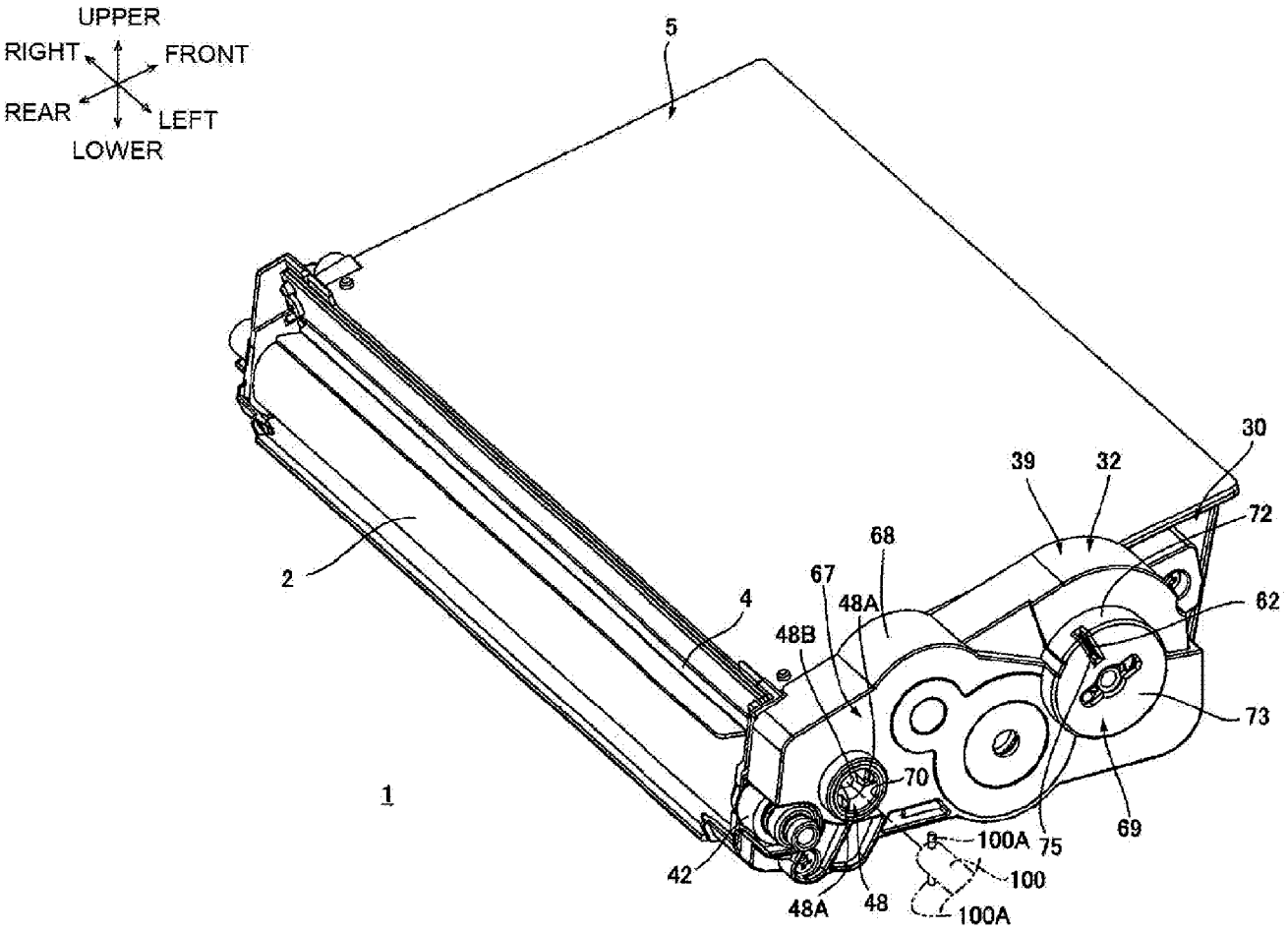
FIG. 1 is a perspective view of a developing cartridge according to an illustrative embodiment of the cartridge of the disclosure, as seen from a left-upper side, illustrating a state where a detection member is located at a retreat position.
Figure 2:
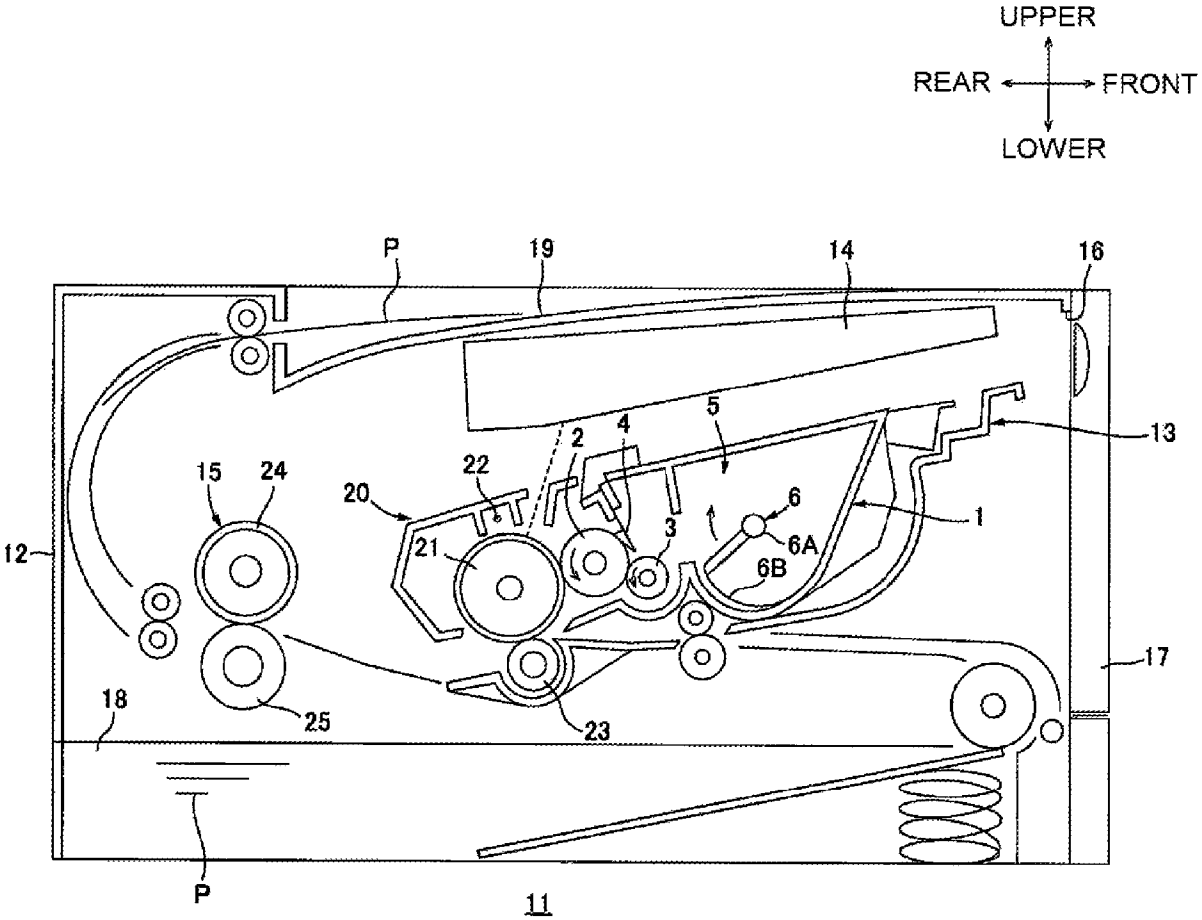
FIG. 2 is a central sectional view of a printer to which the developing cartridge of FIG. 1 is mounted.

As shown in FIGS. 1 and 2, a developing cartridge 1, which is an example of the cartridge, has a developing frame 5, which is an example of the housing, a developing roller 2, which is an example of the developer carrier, a supply roller 3, a layer thickness regulation blade 4 and an agitator 6.

In the description hereinafter, when describing directions of the developing cartridge 1, a side at which the developing roller 2 is arranged is referred to as a rear side of the developing cartridge 1, and an opposite side thereof is referred to as a front side of the developing cartridge 1. Also, the left side and the right side are defined on the basis of a state where the developing cartridge 1 is seen from the front. Specifically, arrow directions indicated in the respective drawings are used as the basis.

Also, a left-right direction is an example of the axis direction, a left side is an example of one side in the axis direction, and a right side is an example of the other side in the axis direction. A front-rear direction is an example of the first direction orthogonal to the axis direction, a front side is an example of one side in the first direction, and a rear side is an example of the other side in the first direction. An upper-lower direction is an example of the second direction orthogonal to both the axis direction and the first direction, an upper side is an example of one side in the second direction, and a lower side is an example of the other side in the second direction.

The developing frame 5 has a substantially box shape opening towards the rear side. The developing frame 5 is configured to accommodate therein toner, which is an example of the developer.

The developing roller 2 is rotatably supported to a rear end portion of the developing frame 5. A rear side of the developing roller 2 is exposed from the developing frame 5. The developing roller 2 has a substantially cylindrical shape extending in the left-right direction.

The supply roller 3 is arranged at a front-lower side of the developing roller 2 in the developing frame 5. The supply roller 3 is rotatably supported to the developing frame 5. The supply roller 3 has a substantially cylindrical shape extending in the left-right direction. The supply roller 3 contacts a front lower end portion of the developing roller 2.

The layer thickness regulation blade 4 is arranged at a front-upper side of the developing roller 2. The layer thickness regulation blade 4 contacts a front end portion of the developing roller 2.

The agitator 6 is arranged at a front-upper side of the supply roller 3 in the developing frame 5. The agitator 6 has an agitator shaft 6A and a stiffing blade 6B.

The agitator shaft 6A has a substantially cylindrical shape extending in the left-right direction. The stirring blade 6B consists of a film having flexibility. The stiffing blade 6B is supported to the agitator shaft 6A.

Figure 4A:
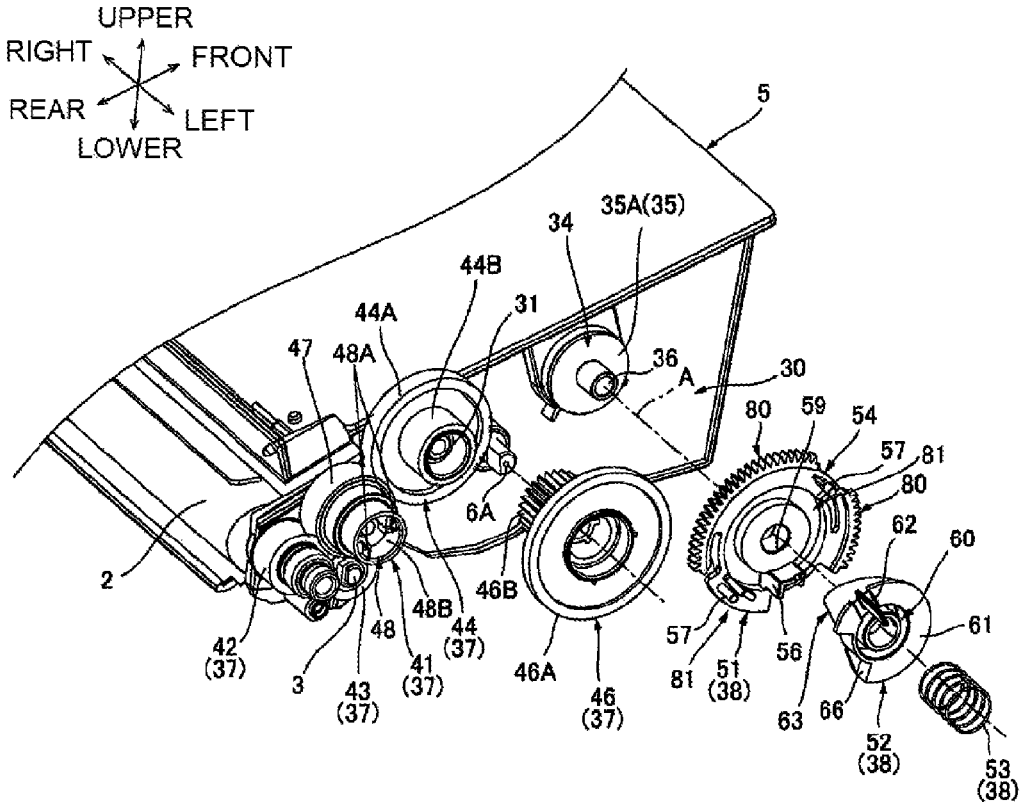
FIG. 4A is an exploded perspective view of a gear train and a detection unit shown in FIG. 3A, as seen from a left-upper side.

Both left and right end portions of the agitator shaft 6A are rotatably supported to a pair of sidewalls 30 which will be described later, so that the agitator 6 is supported to the developing frame 5. Also, as shown in FIG. 4A, the left end portion of the agitator shaft 6A protrudes leftward from the left sidewall 30 which will be described later.

2. Using Aspects of Developing Cartridge

As shown in FIG. 2, the developing cartridge 1 is used by being mounted to a printer 11.

The printer 11 is an electrophotographic image forming apparatus. More specifically, the printer 11 is a monochrome printer. The printer 11 has an apparatus main body 12, which is an example of the external device, a process cartridge 13, a scanner unit 14, and a fixing unit 15.

The apparatus main body 12 has a substantially box shape. The apparatus main body 12 has an opening 16, a front cover 17, a sheet feeding tray 18, and a sheet discharge tray 19.

The opening 16 is arranged at a front end portion of the apparatus main body 12. The opening 16 enables an inside and an outside of the apparatus main body 12 to communicate with each other so that the process cartridge 13 can pass therethrough.

The front cover 17 is arranged at the front end portion of the apparatus main body 12. The front cover 17 has a substantially plate shape. The front cover 17 extends in the upper-lower direction, and is swingably supported to a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a rear side of an upper wall of the apparatus main body 12. The sheet discharge tray 19 is recessed downwardly from an upper surface of the apparatus main body 12 so that the sheet P can be placed thereon.

The process cartridge 13 is accommodated at a substantially center of the apparatus main body 12. The process cartridge 13 is configured to be mounted to or to be detached from the apparatus main body 12. The process cartridge 13 has a drum cartridge 20 and the developing cartridge 1.

The drum cartridge 20 has a photosensitive drum 21, a scorotron-type charger 22 and a transfer roller 23.

The photosensitive drum 21 is rotatably supported to a rear end portion of the drum cartridge 20.

The scorotron-type charger 22 is arranged at an interval from the photosensitive drum 21 at a rear-upper side of the photosensitive drum 21.

The transfer roller 23 is arranged below the photosensitive drum 21. The transfer roller 23 contacts a lower end portion of the photosensitive drum 21.

The developing cartridge 1 is configured to be mounted to or detached from the drum cartridge 20. The developing cartridge 1 is mounted to the drum cartridge 20 so that the developing roller 2 contacts with a front end portion of the photosensitive drum 21 at the front of the photosensitive drum 21.

The scanner unit 14 is arranged above the process cartridge 13. The scanner unit 14 is configured to emit a laser beam based on image data towards the photosensitive drum 21.

The fixing unit 15 is arranged at the rear of the process cartridge 13. The fixing unit 15 has a heating roller 24, and a pressing roller 25. The pressing roller 25 contacts a rear lower end portion of the heating roller 24.

The printer 11 starts an image forming operation under control of a control unit 93, which will be described later. Then, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

The agitator 6 stirs the toner in the developing frame 5, thereby supplying the same to the supply roller 3. The supply roller 3 supplies the toner supplied by the agitator 6 to the developing roller 2. At this time, the toner is positively friction-charged between the developing roller 2 and the supply roller 3, and is then carried on the developing roller 2. The layer thickness regulation blade 4 regulates a layer thickness of the toner carried on the developing roller 2 to a predetermined thickness.

The toner carried on the developing roller 2 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 towards between the photosensitive drum 21 and the transfer roller 23 by rotations of a variety of rollers. The toner image on the surface of the photosensitive drum 21 is transferred to the sheet P when the sheet P passes between the photosensitive drum 21 and the transfer roller 23.

Thereafter, the sheet P is heated and pressed while it passes between the heating roller 24 and the pressing roller 25. Thereby, the toner image on the sheet P is heat-fixed on the sheet P. Then, the sheet P is discharged to the sheet discharge tray 19.

3. Details of Developing Cartridge

As shown in FIG. 1, the developing cartridge 1 has a driving unit 32 arranged at the left side of the developing frame 5.

(1) Developing Frame

The developing frame 5 has the pair of sidewalls 30. The pair of sidewalls 30 is left and right end portions of the developing frame 5. The sidewall 30 has a substantially rectangular plate shape extending in the front-rear direction, as seen from above.

Figure 4B:
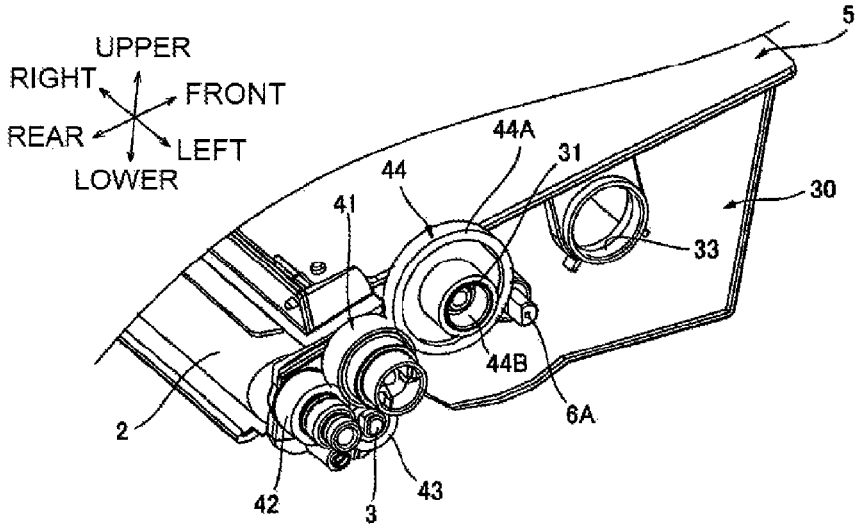
FIG. 4B is a perspective view of a developing frame shown in FIG. 4A with a toner cap being detached, as seen from a left-upper side.

As shown in FIGS. 4A and 4B, the left sidewall 30 of the pair of sidewalls 30 has an idle gear support shaft 31, a toner filling port 33, and a toner cap 34.

The idle gear support shaft 31 is arranged at a substantially center of an upper end portion of the left sidewall 30 in the front-rear direction. The idle gear support shaft 31 has a substantially cylindrical shape extending leftward from the left sidewall 30. The idle gear support shaft 31 is formed integrally with the left sidewall 30.

As shown in FIG. 4B, the toner filling port 33 is arranged at a substantially center of the left sidewall 30 in the front-rear direction. The toner filling port 33 has a substantially circular shape in a side view, and penetrates the left sidewall 30 in the left-right direction.

As shown in FIG. 4A, the toner cap 34 is fitted in the toner filling port 33 to close the toner filling port 33. The toner cap 34 has a cap main body 35 and a support shaft 36.

Figure 8A:
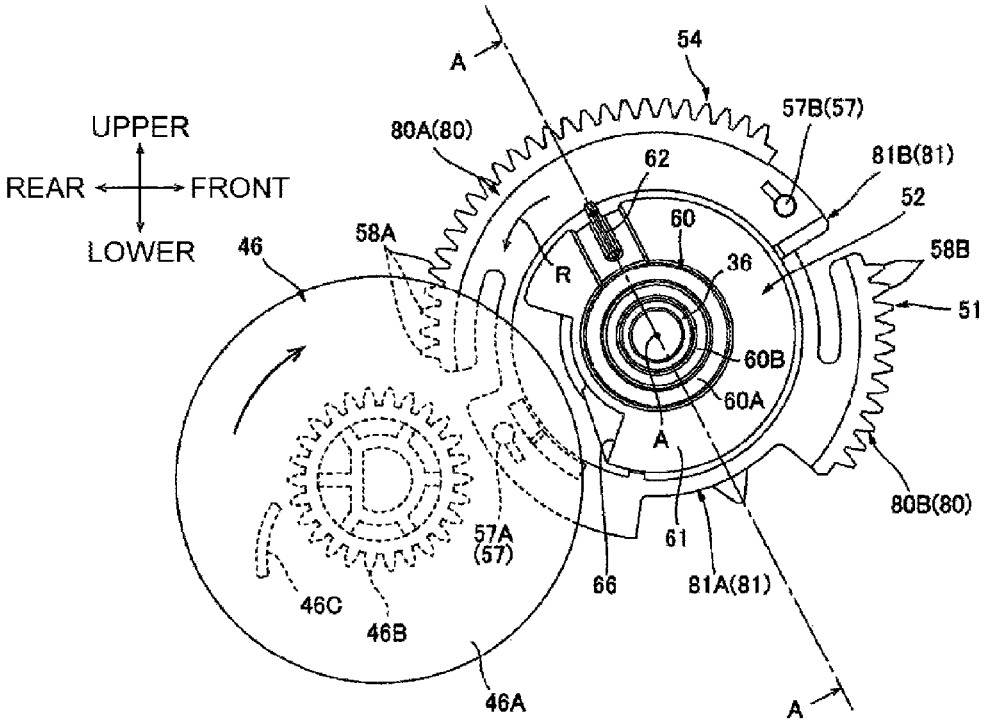
FIG. 8A is a left side view of the detection unit, the toothless gear and an agitator gear shown in FIG. 3A, illustrating an initial state of the toothless gear.
Figure 8B:
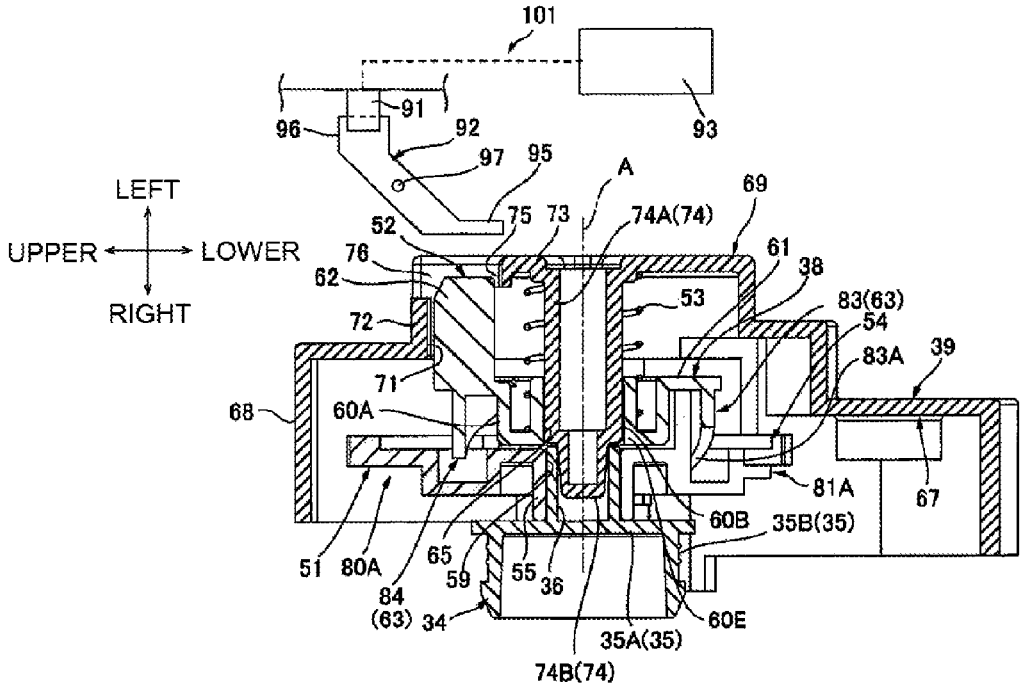
FIG. 8B is a sectional view of the detection unit and toothless gear shown in FIG. 8A taken along a line A-A.

As shown in FIG. 8B, the cap main body 35 has a substantially cylindrical shape extending in the left-right direction and a left end portion thereof is closed. The cap main body 35 has a closing part 35A and an insertion part 35B.

As shown in FIG. 4A, the closing part 35A is a left end portion of the cap main body 35 and has a substantially circular plate shape in a side view. An outer diameter of the closing part 35A is configured to be greater than an inner diameter of the toner filling port 33. As shown in FIG. 4B, the insertion part 35B has a substantially cylindrical shape extending in the left-right direction, and extends rightward from a right surface of the closing part 35A. An outer diameter of the insertion part 35B is smaller than the outer diameter of the closing part 35A and slightly greater than the inner diameter of the toner filling port 33. The insertion part 35B is inserted into the toner filling port 33.

As shown in FIG. 4A, the support shaft 36 has a substantially cylindrical shape extending in the left-right direction, and protrudes leftward from a diametrical center of the left surface of the closing part 35A. That is, a left end portion of the support shaft 36 is opened.

(2) Driving Unit

Figure 3A:
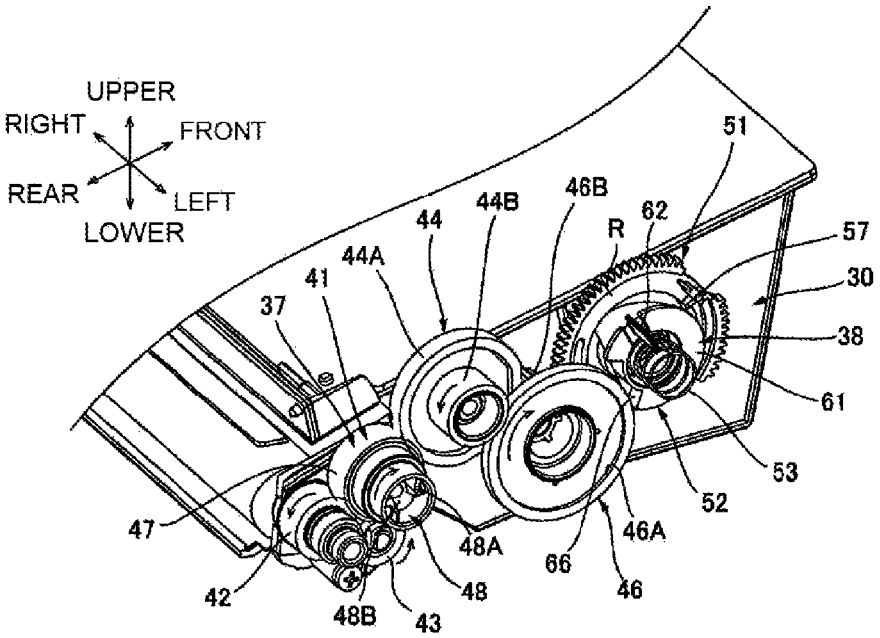
FIG. 3A is a perspective view of the developing cartridge shown in FIG. 1, as seen from a left-upper side, illustrating a state where a gear cover is detached.

As shown in FIGS. 1, 3A and 4A, the driving unit 32 is arranged at the left surface of the left sidewall 30. The driving unit 32 has a gear train 37, a detection unit 38, and a gear cover 39.

(2-1) Gear Train

As shown in FIG. 3A, the gear train 37 has a developing coupling 41, which is an example of the driving receiving part, a developing gear 42, a supply gear 43, an idle gear 44, and an agitator gear 46, which is an example of the transmission member.

The developing coupling 41 is rotatably supported to the left sidewall 30 at a rear end portion of the left sidewall 30.

Specifically, the developing coupling 41 is rotatably supported to a support shaft (not shown) integrally provided for the left sidewall 30. The developing coupling 41 has a substantially cylindrical shape extending in the left-right direction. The developing coupling 41 integrally has a gear part 47 and a coupling part 48.

The gear part 47 is a right part of the developing coupling 41. The gear part 47 has a substantially cylindrical shape extending in the left-right direction and a left end portion thereof is closed. The gear part 47 has gear teeth over an entire circumference thereof.

The coupling part 48 is a left part of the developing coupling 41. The coupling part 48 has a substantially cylindrical shape having an opened left end portion, and extends leftward from a left end surface of the gear part 47. A central axis of the coupling part 48 coincides with a central axis of the gear part 47. As shown in FIG. 1, the coupling part 48 has a pair of protrusions 48A.

The pair of protrusions 48A is respectively arranged at an interval from each other in a diametrical direction of the coupling part 48 in an inner space 48B of the coupling part 48 in the diametrical direction. Each of the pair of protrusions 48A protrudes inward in the diametrical direction from an inner peripheral surface of the coupling part 48, and has a substantially rectangular shape in a side view.

As shown in FIG. 3A, the developing gear 42 is supported to a left end portion of a rotary shaft of the developing roller 2 at a rear-lower side of the developing coupling 41 so that it cannot be relatively rotated. The developing gear 42 has a substantially cylindrical shape extending in the left-right direction. The developing gear 42 has gear teeth over an entire circumference thereof. The developing gear 42 is engaged with a rear lower end portion of the gear part 47 of the developing coupling 41.

The supply gear 43 is supported to a left end portion of a rotary shaft of the supply roller 3 below the developing coupling 41 so that it cannot be relatively rotated. The supply gear 43 has a substantially cylindrical shape extending in the left-right direction. The supply gear 43 has gear teeth over an entire circumference thereof. The supply gear 43 is engaged with a lower end portion of the gear part 47 of the developing coupling 41.

The idle gear 44 is rotatably supported to the idle gear support shaft 31 at a front-upper side of the developing coupling 41. The idle gear 44 integrally has a large diameter gear 44A and a small diameter gear 44B.

The large diameter gear 44A is a right part of the idle gear 44. The large diameter gear 44A has a substantially disc shape having a thickness in the left-right direction. The large diameter gear 44A has gear teeth over an entire circumference thereof. The large diameter gear 44A is engaged with a front upper end portion of the gear part 47 of the developing coupling 41.

The small diameter gear 44B is a left part of the idle gear 44. The small diameter gear 44B has a substantially cylindrical shape and extends leftward from a left surface of the large diameter gear 44A. A central axis of the small diameter gear 44B coincides with a central axis of the large diameter gear 44A. An outer diameter of the small diameter gear 44B is smaller than an outer diameter of the large diameter gear 44A. The small diameter gear 44B has gear teeth over an entire circumference thereof.

As shown in FIG. 4A, the agitator gear 46 is supported to a left end portion of the agitator shaft 6A at a front-lower side of the idle gear 44 so that it cannot be relatively rotated. As shown in FIGS. 4A and 8A, the agitator gear 46 has a first gear part 46A, a second gear part 46B, and an abutting rib 46C, which is an example of the engaging part.

As shown in FIG. 4A, the first gear part 46A is a left part of the agitator gear 46. The first gear part 46A has a substantially disc shape having a thickness in the left-right direction. The first gear part 46A has gear teeth over an entire circumference thereof. As shown in FIG. 3A, the first gear part 46A is engaged with a front lower end portion of the small diameter gear 44B of the idle gear 44.

As shown in FIG. 4A, the second gear part 46B is a right part of the agitator gear 46. The second gear part 46B has a substantially cylindrical shape and extends rightward from a right surface of the first gear part 46A. A central axis of the second gear part 46B coincides with a central axis of the first gear part 46A. An outer diameter of the second gear part 46B is smaller than an outer diameter of the first gear part 46A. The second gear part 46B has gear teeth over an entire circumference thereof.

As shown in FIG. 8A, the abutting rib 46C is arranged at a rear-lower side of the second gear part 46B on a right surface of the first gear part 46A at a diametrical interval from the second gear part 46B. The abutting rib 46C has a substantially plate shape and protrudes rightwards from the right surface of the first gear part 46A. The abutting rib 46C extends so that it is inclined in a counterclockwise direction towards an outer side in the diametrical direction of the first gear part 46A, as seen from a left side.

(2-2) Detection Unit

As shown in FIG. 3A, the detection unit 38 is arranged at a front-upper side with respect to the agitator gear 46. As shown in FIG. 4A, the detection unit 38 has a toothless gear 51, which is an example of the rotary member, a detection member 52, which is an example of the detected member, and a compression spring 53, which is an example of the urging member.

The toothless gear 51 is arranged at a right end portion of the detection unit 38, and is arranged at a front-upper side with respect to the agitator gear 46. Although it will be specifically described later, as shown in FIG. 8A, a driving force is transmitted from the agitator gear 46 to the toothless gear 51, so that the toothless gear 51 is irreversibly rotated from an initial state to a terminal state in a rotating direction R, which is a counterclockwise direction, as seen from a left side.

Thus, in the below descriptions of the toothless gear 51, the toothless gear 51 is described on the basis of the initial state shown in FIGS. 3A, 4A, 5A, 5B, 8A and 8B.

Figure 5A:
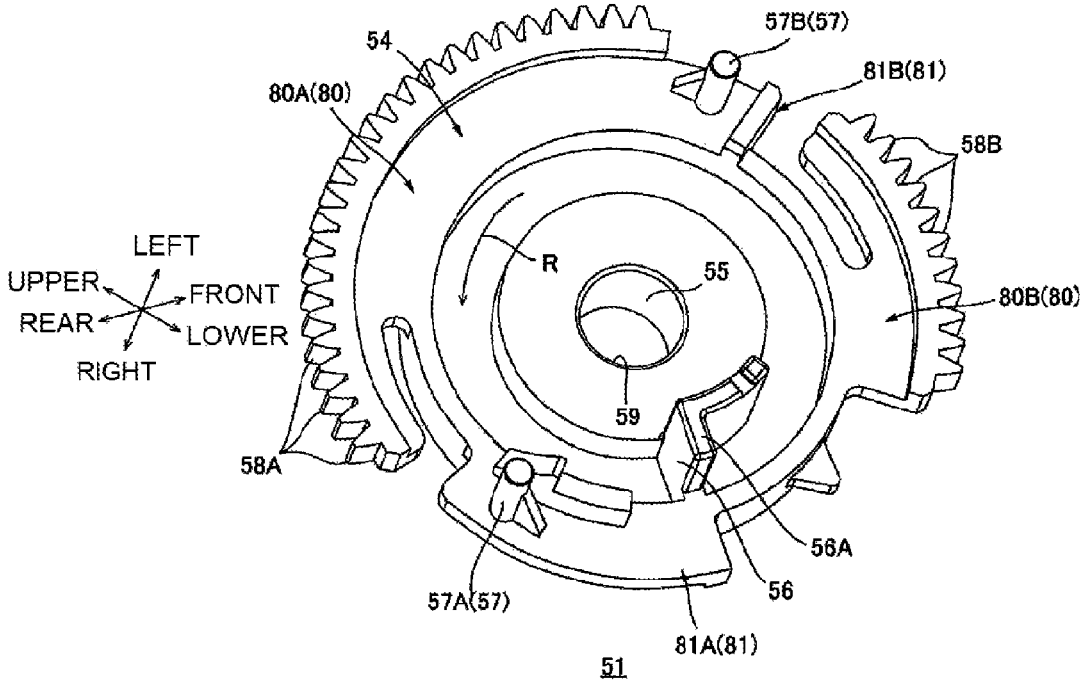
FIG. 5A is a perspective view of a toothless gear shown in FIG. 4A, as seen from a left-lower side.
Figure 5B:
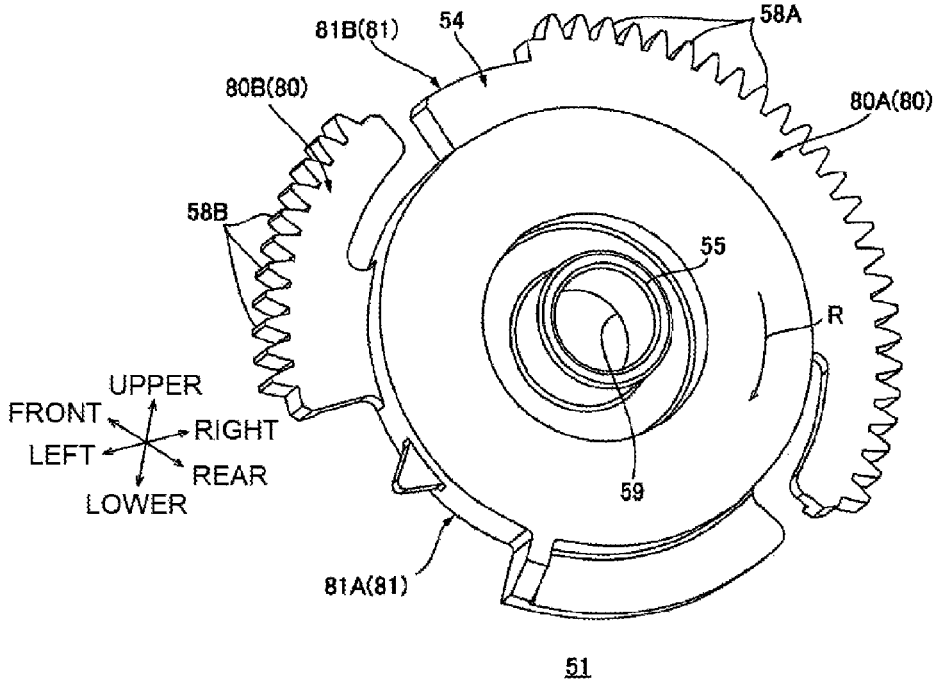
FIG. 5B is a perspective view of the toothless gear shown in FIG. 5A, as seen from a right-lower side.

As shown in FIGS. 5A and 5B, the toothless gear 51 has a gear main body 54, a collar part 55, a slide rib 56 and a plurality of bosses 57, which is an example of the engaged part.

The gear main body 54 has a substantially disc shape having a thickness in the left-right direction. The gear main body 54 has a plurality of teeth parts 80, which is an example of the contact part, and a plurality of toothless parts 81, which is an example of the separation part.

The plurality of teeth parts 80 is parts having gear teeth on a circumference of the gear main body 54 and is arranged at an interval in the rotating direction R. Specifically, the plurality of teeth parts 80 is two teeth parts 80 and has a first teeth part 80A, which is an example of the first contact part, and a second teeth part 80B, which is an example of the second contact part.

The first teeth part 80A is a part of the gear main body 54 having a central angle of about 130°, and has a fan-like plate shape in a side view. The first teeth part 80A has gear teeth 58A over a circumference thereof.

The second teeth part 80B is arranged upstream from the first teeth part 80A in the rotating direction R at an interval of a central angle of about 40°, specifically with a second toothless part 81B, which will be described later, being interposed therebetween. The second teeth part 80B is a part of the gear main body 54 having a central angle of about 60°, and has a substantially fan-like plate shape in a side view. The second teeth part 80B has gear teeth 58B over a circumference thereof.

The toothless parts 81 are parts having no gear teeth on the circumference of the gear main body 54 and are arranged at an interval in the rotating direction R, specifically, with the teeth parts 80 being interposed therebetween. Specifically, the plurality of toothless parts 81 is two toothless parts 81 and has a first toothless part 81A, which is an example of the first separation part, and a second toothless part 81B, which is an example of the second separation part.

The first toothless part 81A is closely arranged downstream from the first teeth part 80A in the rotating direction R and is closely arranged upstream from the second teeth part 80B in the rotating direction R. The first toothless part 81A is a part having a central angle of about 130° of the gear main body 54 and has a substantially fan-like plate shape in a side view.

The second toothless part 81B is closely arranged upstream from the first teeth part 80A in the rotating direction R and is closely arranged downstream from the second teeth part 80B in the rotating direction R. That is, the second toothless part 81B is arranged between the first teeth part 80A and the second teeth part 80B in the rotating direction R. Also, the second toothless part 81B is arranged upstream from the first toothless part 81A in the rotating direction R at an interval of a central angle of about 130°, specifically with the first teeth part 80A being interposed therebetween. The second toothless part 81B is a part having a central angle of about 40° of the gear main body 54, and has a substantially fan-like plate shape in a side view.

Also, the gear main body 54 has a fitting hole 59. The fitting hole 59 is arranged at a diametrical center of the gear main body 54. The fitting hole 59 has a substantially circular shape in a side view, and is configured to penetrate the gear main body 54 in the left-right direction. As shown in FIG. 8B, an inner diameter of the fitting hole 59 is substantially the same as an outer diameter of the support shaft 36.

As shown in FIG. 5B, the collar part 55 is arranged on the right surface of the gear main body 54. The collar part 55 has a substantially cylindrical shape extending in the left-right direction, and protrudes rightward from a peripheral edge of the fitting hole 59 of the gear main body 54. An inner diameter of the collar part 55 is substantially the same as the inner diameter of the fitting hole 59.

As shown in FIG. 5A, the slide rib 56 is arranged at a substantially center of the first toothless part 81A in the circumferential direction and at a substantially center of the first toothless part 81A in the diametrical direction on the left surface of the first toothless part 81A. The slide rib 56 has a substantially plate shape extending in the diametrical direction of the gear main body 54, and protrudes leftward from the left side of the first toothless part 81A.

The plurality of bosses 57 is arranged on the left surface of the gear main body 54. The plurality of bosses 57 is arranged to correspond to the plurality of toothless parts 81, respectively. Specifically, the plurality of bosses 57 has a first boss 57A, which is an example of the first engaged part, and a second boss 57B, which is an example of the second engaged part.

The first boss 57A corresponds to the first toothless part 81A, and is arranged upstream from the slide rib 56 in the rotating direction R at an interval therebetween on the left surface of the first toothless part 81A. The first boss 57A has a substantially cylindrical shape, and protrudes leftward from an outer part in the diametrical direction of the left surface of the first toothless part 81A.

The second boss 57B corresponds to the second toothless part 81B, and is arranged at an outer part in the diametrical direction of the left surface of the second toothless part 81B. Thereby, the second boss 57B is arranged upstream from the first boss 57A in the rotating direction R at an interval therebetween. The second boss 57B has a substantially cylindrical shape, and protrudes leftward from the left surface of the second toothless part 81B.

As shown in FIG. 8B, the collar part 55 and the fitting hole 59 accommodate therein the support shaft 36 to be relatively rotated, so that the toothless gear 51 is supported to the support shaft 36. Thereby, the toothless gear 51 rotates about a central axis A of the support shaft 36, which is a center of rotation.

Figure 6A:
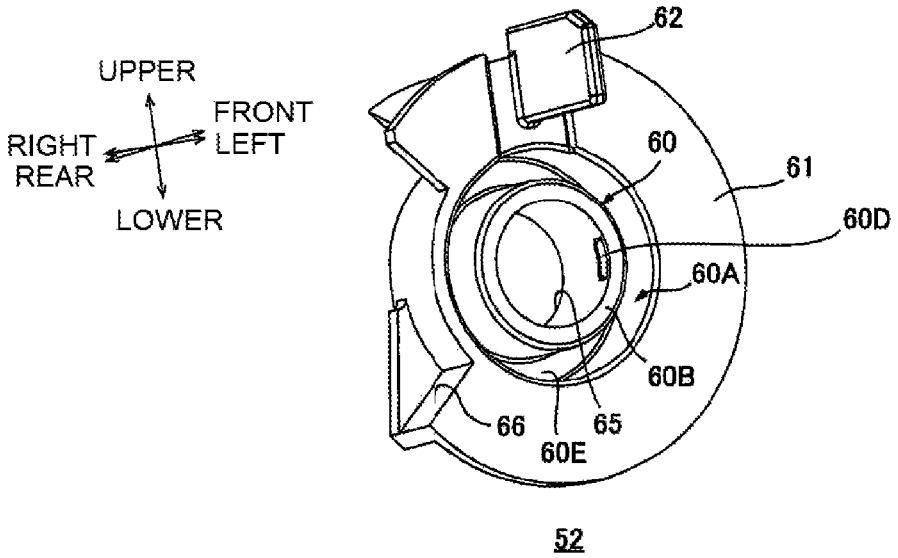
FIG. 6A is a perspective view of the detection member shown in FIG. 4A, as seen from a left-rear side.
Figure 6B:
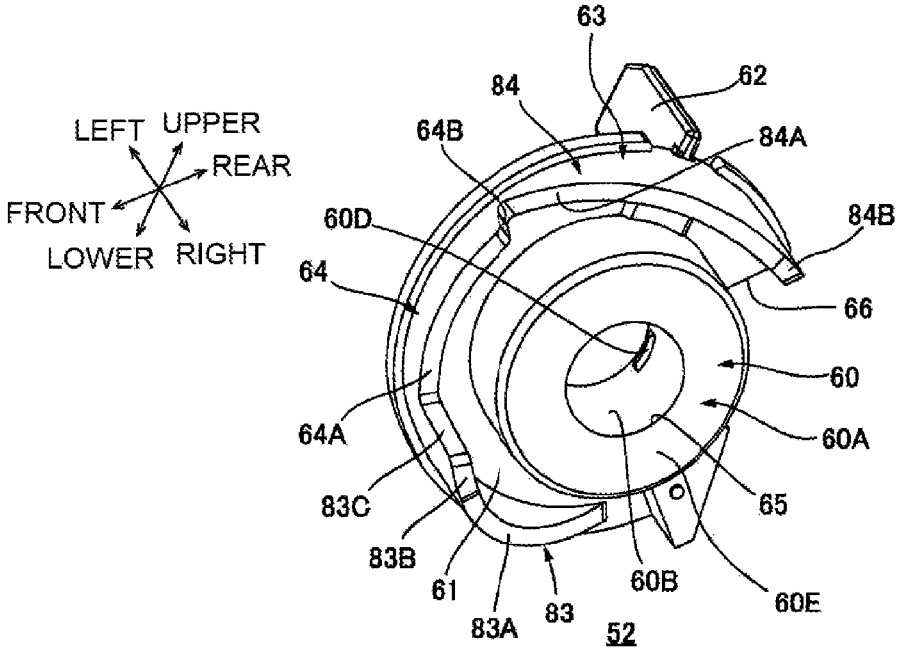
FIG. 6B is a perspective view of the detection member shown in FIG. 6A, as seen from a right-upper side.

As shown in FIG. 4A, the detection member 52 is arranged at the left of the toothless gear 51. That is, the detection member 52 is arranged at an opposite side of the left sidewall 30 with respect to the toothless gear 51. As shown in FIGS. 6A and 6B, the detection member 52 is configured as a separate member from the toothless gear 51, and integrally has a cylindrical part 60, a collar part 61, a detection projection 62, which is an example of the detected part, and a displacement part 63.

The cylindrical part 60 is arranged at a substantially central portion of the detection member 52 in the diametrical direction. The cylindrical part 60 has an outer cylinder 60A and an inner cylinder 60B.

As shown in FIG. 6B, the outer cylinder 60A has a substantially cylindrical shape extending in the left-right direction and a right end portion thereof is closed. The outer cylinder 60A has a through-hole 65.

The through-hole 65 is arranged at a central portion of a right wall 60E of the outer cylinder 60A in the diametrical direction. The through-hole 65 has a substantially circular shape in a side view, and penetrated the right wall 60E of the outer cylinder 60A in the left-right direction. A center of the through-hole 65 coincides with a central axis of the outer cylinder 60A. An inner diameter of the through-hole 65 is substantially the same as the outer diameter of the support shaft 36.

As shown in FIG. 6A, the inner cylinder 60B is arranged in the outer cylinder 60A. The inner cylinder 60B has a substantially cylindrical shape extending in the left-right direction and protrudes leftward from a peripheral edge of the through-hole 65 on the right wall 60E of the outer cylinder 60A. An inner diameter of the inner cylinder 60B is the same as the inner diameter of the through-hole 65. A central axis of the inner cylinder 60B coincides with the central axis of the outer cylinder 60A. A size of the inner cylinder 60B in the left-right direction is substantially the same as a size of the outer cylinder 60A in the left-right direction. The inner cylinder 60B has a pair of engaging projections 60D.

The pair of engaging projections 60D is respectively arranged on both inner surfaces of the inner cylinder 60B in the diametrical direction. Each of the pair of engaging projections 60D is a protuberance protruding inward in the diametrical direction from the inner surface of the inner cylinder 60B and extending circumferentially.

The collar part 61 has a substantially circular ring-like plate shape in a side view, and is enlarged outward in the diametrical direction from a left end portion of the outer cylinder 60A. The collar part 61 has a notched portion 66.

As shown in FIG. 8A, the notched portion 66 is arranged at a rear side of the collar part 61, and is arranged at a part overlapping with a front end portion of the first gear part 46A of the agitator gear 46, as seen in the left-right direction. The notched portion 66 is recessed forward from a rear end edge of the collar part 61 and extends in a circumferential direction of the collar part 61. That is, the collar part 61 is notched at a part overlapping with the first gear part 46A, as seen in the left-right direction.

As shown in FIG. 6A, the detection projection 62 is arranged at an upper end portion of a left surface of the collar part 61. The detection projection 62 has a substantially rectangular plate shape, as seen from the front side, and extends leftward from the left surface of the collar part 61. The detection projection 62 extends along the diametrical direction of the collar part 61.

As shown in FIG. 6B, the displacement part 63 is arranged at a peripheral edge part of the collar part 61. The displacement part 63 has a substantially C-shaped plate shape protruding rightward from the right surface of the peripheral edge part of the collar part 61 and extending in the circumferential direction of the collar part 61 in a side view. The displacement part 63 has a first displacement part 83, a connection part 64 and a second displacement part 84.

The first displacement part 83 is arranged at an upstream end portion of the displacement part 63 in the counterclockwise direction, as seen from the left side. The first displacement part 83 has a first inclined surface 83A, which is an example of the inclined surface, a first parallel surface 83B, and a second inclined surface 83C.

Figure 9:
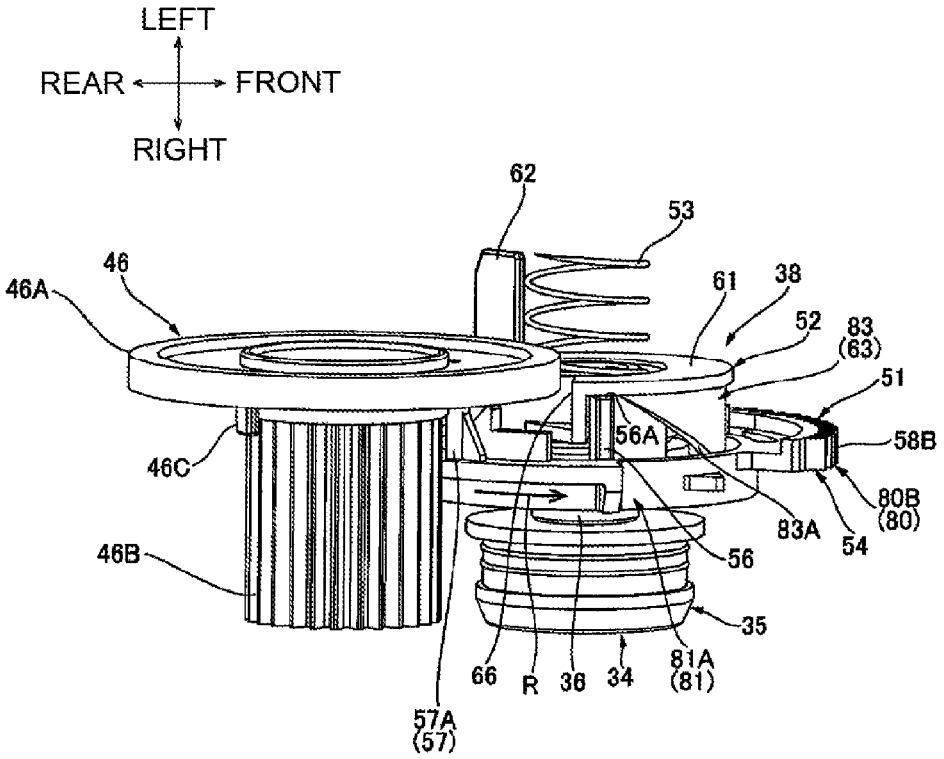
FIG. 9 is a perspective view of the detection unit, the toothless gear and the agitator gear shown in FIG. 8A, as seen from a left-lower side.

As shown in FIG. 9, the first inclined surface 83A is an upstream end portion of a right surface of the first displacement part 83 in the counterclockwise direction, as seen from the left side. The first inclined surface 83A continues to the right surface of the collar part 61 and is inclined rightward towards a downstream side in the counterclockwise direction, as seen from the left side.

As shown in FIG. 6B, the first parallel surface 83B continues from the first inclined surface 83A and extends downstream in the counterclockwise direction, as seen from the left side. The first parallel surface 83B is parallel with the right surface of the collar part 61 so that a distance thereof from the right surface of the collar part 61 in the left-right direction is constant.

The second inclined surface 83C is a downstream end portion of the right surface of the first displacement part 83 in the counterclockwise direction, as seen from the left side. The second inclined surface 83C continues from the first parallel surface 83B and extends so that it is inclined leftward towards the downstream side in the counterclockwise direction, as seen from the left side.

The connection part 64 is arranged to continue to a downstream side of the first displacement part 83 in the counterclockwise direction, as seen from the left side. The connection part 64 is arranged between the first displacement part 83 and the second displacement part 84 in the circumferential direction of the collar part 61 and connects the same. The connection part 64 has a continuous surface 64A and a notched surface 64B, which is an example of the restraint part.

The continuous surface 64A is a right surface of the connection part 64, and extends downstream in the counterclockwise direction continuously from a left end portion of the second inclined surface 83C of the first displacement part 83, as seen from the left side. The continuous surface 64A is parallel with the right surface of the collar part 61 so that a distance thereof from the right surface of the collar part 61 in the left-right direction is constant.

Figure 14:
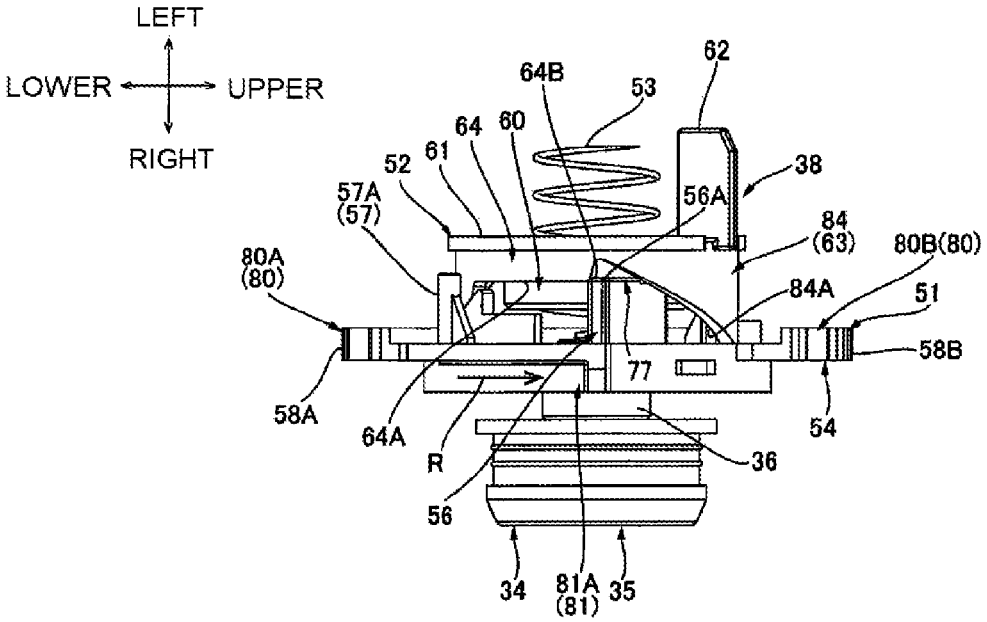
FIG. 14 is a front view of the detection unit, the toothless gear and the agitator gear subsequent to FIG. 13A, illustrating a state just after the abutting rib of the agitator gear passes below the second boss of the toothless gear.

The notched surface 64B is a downstream end portion of the right surface of the connection part 64 in the counterclockwise direction, as seen from the left side, and is arranged at a downstream side of the continuous surface 64A in the counterclockwise direction, as seen from the left side. As shown in FIG. 14, the notched surface 64B extends continuously from the continuous surface 64A so that it is inclined downstream in the counterclockwise direction toward the left side, as seen from the left side.

The second displacement part 84 is arranged at a downstream end portion of the left surface of the displacement part 63 in the counterclockwise direction, as seen from the left side, and is arranged to continue to a downstream side of the connection part 64 in the counterclockwise direction, as seen from the left side. The second displacement part 84 has a third inclined surface 84A, which is an example of the inclined surface, a second parallel surface 84B, and a fourth inclined surface 84C.

The third inclined surface 84A continues to a left end portion of the notched surface 64B and is inclined rightward towards the downstream side in the counterclockwise direction, as seen from the left side.

Thereby, the continuous part of the notched surface 64B and the first inclined surface 83A defines a recess portion 77 recessed leftward.

As shown in FIG. 6B, the second parallel surface 84B continues from the third inclined surface 84A and extends downstream in the counterclockwise direction, as seen from the left side. The second parallel surface 84B is parallel with the right surface of the collar part 61 so that a distance thereof from the right surface of the collar part 61 in the left-right direction is constant.

Figure 18A:
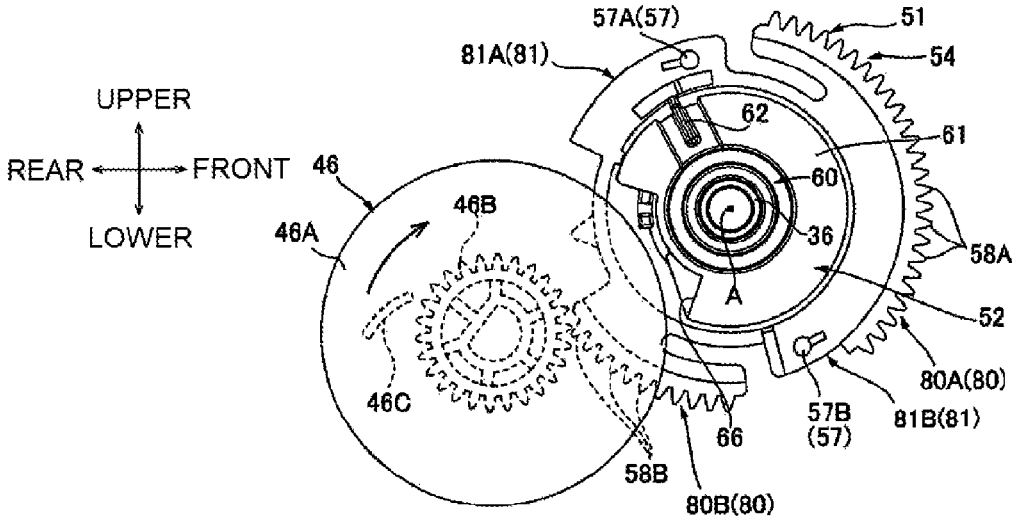
FIG. 18A illustrates the detection operation of the developing cartridge subsequent to FIG. 17A, illustrating a state where the toothless gear is being rotated from the secondary driving state towards a terminal state.
Figure 18B:
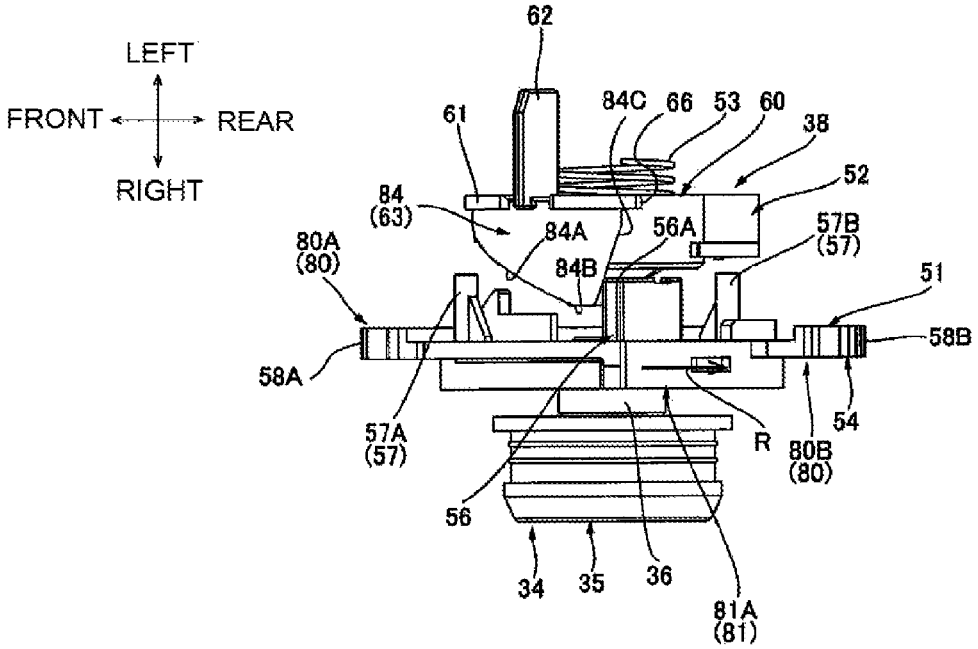
FIG. 18B is a perspective view of the detection unit, the toothless gear and the agitator gear shown in FIG. 18A, as seen from a rear-upper side.

As shown in FIG. 18B, the fourth inclined surface 84C is a downstream end portion of the right surface of the second displacement part 84 in the counterclockwise direction, as seen from the left side. The fourth inclined surface 84C continues from the second parallel surface 84B and is inclined leftward towards the downstream side in the counterclockwise direction, as seen from a left side. Also, a downstream end portion of the fourth inclined surface 84C in the counterclockwise direction, as seen from the left side, continues to the right surface of the collar part 61.

As shown in FIG. 8B, the detection member 52 is arranged so that the through-hole 65 communicates with an internal space of the support shaft 36 in the left-right direction and the first inclined surface 83A, the first parallel surface 83B, the second inclined surface 83C, the continuous surface 64A, the notched surface 64B, the third inclined surface 84A, the second parallel surface 84B and the fourth inclined surface 84C face the gear main body 54 in the left-right direction. That is, as shown in FIGS. 9 and 14, each of the first inclined surface 83A and the third inclined surface 84A is inclined to be closer to the gear main body 54 towards the downstream side in the rotating direction R.

As shown in FIG. 4A, the compression spring 53 is arranged at the left of the detection member 52, i.e., at the opposite side of the left sidewall 30. The compression spring 53 has an air-core coil shape extending in the left-right direction. As shown in FIG. 8B, an inner diameter of the compression spring 53 is substantially the same as the outer diameter of the inner cylinder 60B. The inner cylinder 60B is inserted to a right end portion of the compression spring 53, so that the compression spring 53 is supported to the detection member 52.

(2-3) Gear Cover

Figure 3B:
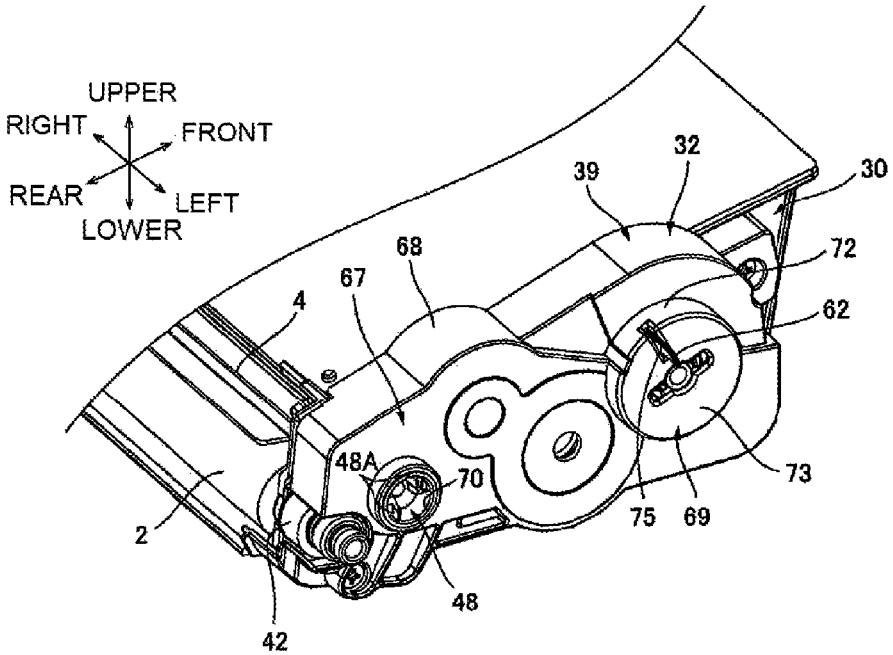
FIG. 3B is a perspective view of the developing cartridge shown in FIG. 1, as seen from a left-upper side, illustrating a state where the detection member is located at an advance position.
Figure 7:
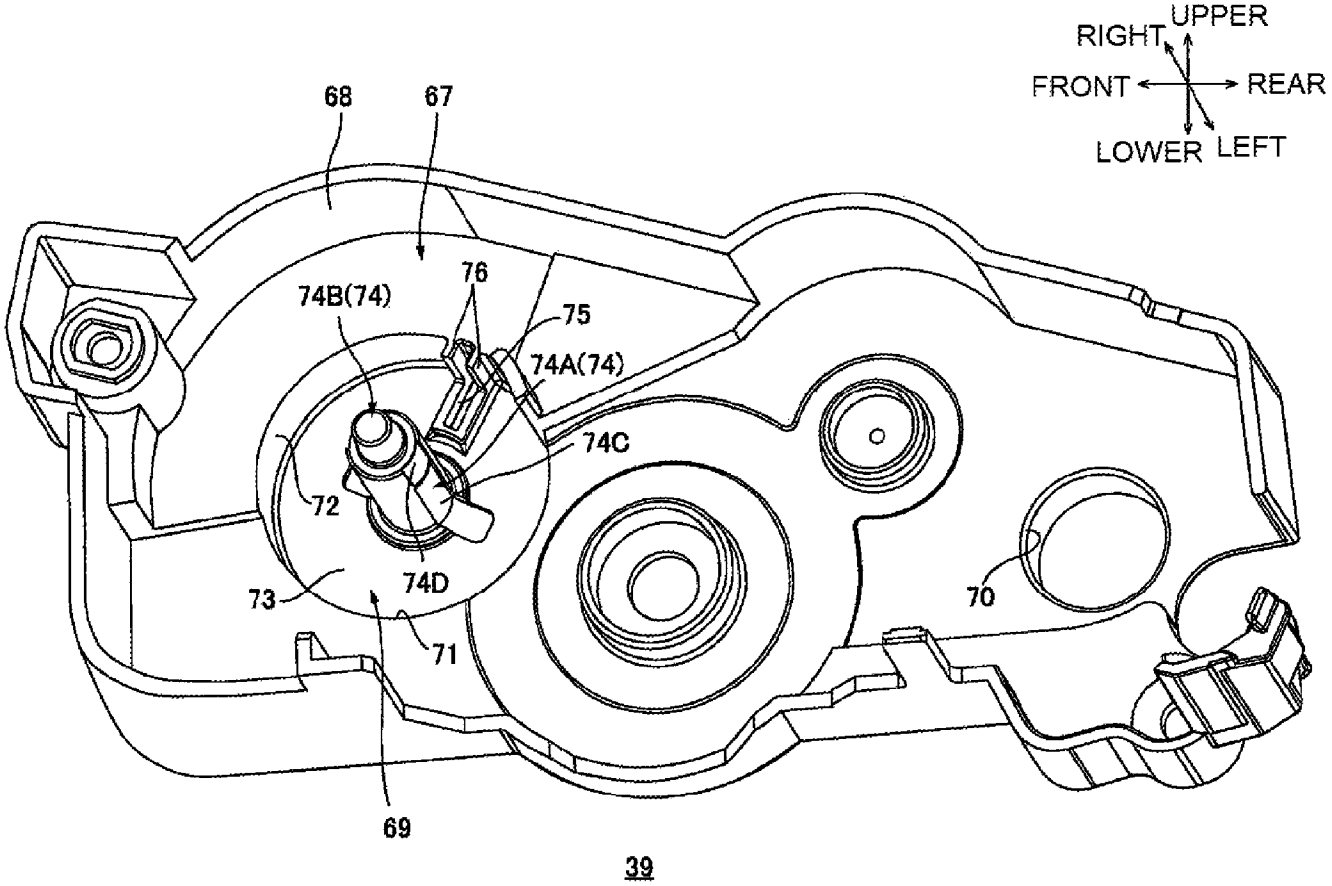
FIG. 7 is a perspective view of the gear cover shown in FIG. 1, as seen from a right-lower side.

As shown in FIGS. 1 and 3B, the gear cover 39 is configured to cover the gear train 37 and the detection unit 38. As shown in FIG. 7, the gear cover 39 has a substantially box shape opening rightward. The gear cover 39 integrally has a cover plate 67, a detection member accommodation part 69, and a peripheral sidewall 68.

The cover plate 67 is arranged at the left side of the gear train 37 and the detection unit 38, and covers the gear train 37 and the detection unit 38 from the left side. The cover plate 67 has a substantially rectangular plate shape extending in the front-rear direction in a side view. The cover plate 67 has a coupling exposing hole 70, and a detection member passing hole 71.

The coupling exposing hole 70 is arranged at a rear end portion of the cover plate 67. The coupling exposing hole 70 has a substantially circular shape in a side view, and penetrates the cover plate 67 in the left-right direction. An inner diameter of the coupling exposing hole 70 is substantially the same as an outer diameter of the coupling part 48.

The detection member passing hole 71 is arranged at a front end portion of the cover plate 67. The detection member passing hole 71 has a substantially circular shape in a side view, and penetrates the cover plate 67 in the left-right direction. As shown in FIG. 8B, an inner diameter of the detection member passing hole 71 is configured to be greater than the outer diameter of the collar part 61.

As shown in FIGS. 1 and 7, the detection member accommodation part 69 protrudes leftward from the front end portion of the cover plate 67. As shown in FIG. 7, the detection member accommodation part 69 has a circumferential wall 72, a closing wall 73, a guide shaft 74, and a pair of guide ribs 76.

The circumferential wall 72 has a substantially cylindrical shape extending in the left-right direction, and protrudes leftward from a peripheral edge of the detection member passing hole 71 of the cover plate 67.

The closing wall 73 is configured to close a left end surface of the circumferential wall 72, and has a substantially circular plate shape in a side view. The closing wall 73 has a slit 75.

The slit 75 is arranged at a rear-upper side of the closing wall 73. The slit 75 extends in a diametrical direction of the closing wall 73, and penetrates the closing wall 73 in the left-right direction. The slit 75 has a size permitting the detection projection 62 to pass therethrough.

The guide shaft 74 has a substantially cylindrical shape extending in the left-right direction, and extends rightward from a center of the closing wall 73 in the diametrical direction. The guide shaft 74 has a base end portion 74A and a tip portion 74B.

The base end portion 74A is a left part of the guide shaft 74 and has a substantially cylindrical shape extending in the left-right direction. As shown in FIG. 8B, an outer diameter of the base end portion 74A is substantially the same as the inner diameter of the inner cylinder 60B, and is also substantially the same as the outer diameter of the support shaft 36.

As shown in FIG. 7, the base end portion 74A has guide recesses 74C and engaging claws 74D.

The guide recesses 74C are arranged at both end portions of the base end portion 74A in the front-rear direction. The guide recess 74C is recessed inward in a diametrical direction from an outer peripheral surface of the base end portion 74A and extends in the left-right direction.

The engaging claw 74D is arranged in a right end portion of the guide recess 74C. The engaging claw 74D protrudes outward in the diametrical direction from an inner surface of the guide recess 74C in the diametrical direction. An outer surface of the engaging claw 74D in the diametrical direction is inclined towards the outer side in the diametrical direction towards the left side.

The tip portion 74B is a right part of the guide shaft 74. The tip portion 74B has a truncated cone shape tapering rightward and protrudes rightward from a right end portion of the base end portion 74A. A central axis of the tip portion 74B coincides with a central axis of the base end portion 74A. A radius of a left end portion (lower base) of the tip portion 74B is configured to be smaller than an outer diameter of the base end portion 74A.

The pair of guide ribs 76 is arranged at an interval in a circumferential direction of the circumferential wall 72 on an inner peripheral surface of the circumferential wall 72 so that an upper end portion of the slit 75 is positioned therebetween. Each of the pair of guide ribs 76 protrudes inward in the diametrical direction from a rear upper end portion of the inner surface of the circumferential wall 72 and extends in the left-right direction. A left end portion of each of the pair of guide ribs 76 continues to a peripheral edge of the upper end portion of the slit 75 of the closing wall 73.

The peripheral sidewall 68 protrudes rightward from the peripheral end edge of the cover plate 67.

As shown in FIG. 8B, the gear cover 39 is mounted to the left sidewall 30 so that the tip portion 74B of the guide shaft 74 is inserted into the support shaft 36 and the base end portion 74A of the guide shaft 74 is inserted into the compression spring 53 and the inner cylinder 60B.

Thereby, the detection member 52 is supported to the guide shaft 74 of the gear cover 39 so that it can move in the left-right direction. Also, the engaging projection 60D of the detection member 52 is fitted in the guide recess 74C at the left side of the engaging claw 74D.

Also, the compression spring 53 is interposed between the right wall 60E of the outer cylinder 60A of the detection member 52 and the closing wall 73 of the gear cover 39. Thereby, a right end portion of the compression spring 53 contacts with the left surface of the right wall of the outer cylinder 60A, and a left end portion of the compression spring 53 contacts with the right surface of the closing wall 73. For this reason, the compression spring 53 is configured to always urge the detection member 52 rightward, i.e., towards the left sidewall 30.

Also, as shown in FIG. 1, the coupling part 48 of the developing coupling 41 is fitted in the coupling exposing hole 70.

(2-4) State of Detection Unit in New Developing Cartridge

Hereinafter, a state of the detection unit 38 of the new developing cartridge 1, i.e., the developing cartridge 1 before it is first used, will be described.

As shown in FIG. 8A, the toothless gear 51 of the new developing cartridge 1 is in an initial state, which is an example of the second state.

At the initial state of the toothless gear 51, the downstream end portion of the first teeth part 80A in the rotating direction R is arranged at an interval from a front-upper side of the second gear part 46B of the agitator gear 46, and the upstream part of the first toothless part 81A in the rotating direction R faces the second gear part 46B at an interval therebetween in the diametrical direction of the toothless gear 51. That is, the toothless gear 51 in the initial state is spaced from the agitator gear 46.

At this time, the first boss 57A is arranged at a rightward interval from the front part of the first gear part 46A, and is also arranged at a forward interval from the second gear part 46B.

Also, as shown in FIG. 9, the slide rib 56 is arranged at the rear of the first displacement part 83 of the detection member 52. A free end portion 56A of the slide rib 56 contacts with the right surface of the collar part 61 at the rear of the first inclined surface 83A.

Also, the detection member 52 is located at a retreat position at which it is located at the most relatively rightward position, by the urging force of the compression spring 53.

At this time, as shown in FIG. 8B, the detection projection 62 of the detection member 52 is accommodated in the detection member accommodation part 69 so that it coincides with the slit 75, as seen from the left side. Thereby, a left end surface of the detection projection 62 is positioned at the right side of the left surface of the closing wall 73.

Also, an upper end portion of the detection projection 62 is arranged between the pair of guide ribs 76.

Also, as shown in FIG. 1, the left end portion of the detection projection 62 is arranged in the slit 75, and the engaging projection 60D of the detection member 52 is fitted in the guide recess 74C, as described above. Thereby, the detection member 52 is restrained from rotating relatively to the guide shaft 74 and from further moving rightward.

4. Details of Apparatus Main Body

As shown in FIGS. 1 and 8B, the apparatus main body 12 has a main body coupling 100, and a detection mechanism 101.

As shown in FIG. 1, the main body coupling 100 is arranged at a leftward interval from the coupling part 48 of the developing coupling 41 with the developing cartridge 1 being mounted to the apparatus main body 12. Also, the main body coupling 100 has a substantially cylindrical shape extending in the left-right direction and is configured so that a right end portion thereof can be inserted into the internal space 48B of the coupling part 48.

The main body coupling 100 has a pair of engaging projections 100A. Each of the pair of engaging projections 100A has a substantially cylindrical shape extending in the outer side in the diametrical direction of the main body coupling 100. The pair of engaging projections 100A is arranged at an interval of 180° in a circumferential direction on a circumferential surface of a right end portion of the main body coupling 100.

The main body coupling 100 is configured to move in the left-right direction in accordance with the opening/closing operation of the front cover 17 by a well-known interlocking mechanism. Also, the main body coupling 100 is configured so that a driving force from a driving source such as a motor (not shown) provided for the apparatus main body 12 is transmitted thereto. When the driving force is transmitted, the main body coupling 100 is rotated in the clockwise direction, as seen from the left side.

As shown in FIG. 8B, the detection mechanism 101 has an optical sensor 91, an actuator 92, and a control unit 93.

The optical sensor 91 is arranged at a left-upper side of the detection member accommodation part 69 with the developing cartridge 1 being mounted to the apparatus main body 12. The optical sensor 91 has a light emitting device and a light receiving device facing each other at an interval in the front-rear direction. The light emitting device is configured to always emit detection light towards the light receiving device. The light receiving device receives the detection light emitted from the light emitting device. The optical sensor 91 generates a light receiving signal when the light receiving device receives the detection light, and does not generate a light receiving signal when the light receiving device does not receive the detection light. The optical sensor 91 is electrically connected to the control unit 93.

The actuator 92 is arranged at the right of the optical sensor 91. The actuator 92 has a substantially rod shape connecting a left-upper side and a right-lower side. The actuator 92 has a shaft 97, an abutting part 95 and a light shielding part 96.

The shaft 97 has a substantially cylindrical shape extending in the front-rear direction and is arranged at a substantially center of the actuator 92 in the upper-lower direction. The shaft 97 is rotatably supported in the apparatus main body 12, so that the actuator 92 can be rotated to a non-detection position at which the detection light of the optical sensor 91 is shielded, as shown in FIG. 8B, and to a detection position at which the detection light of the optical sensor 91 is not shielded, as shown in FIG. 11B, about the shaft 97 serving as a support point.

As shown in FIG. 8B, the abutting part 95 is arranged at a right lower end portion of the actuator 92. The abutting part 95 has a substantially plate shape extending in the front-rear and upper-lower directions. The abutting part 95 is arranged at a leftward interval from the slit 75 of the detection member accommodation part 69 with the developing cartridge 1 being mounted to the apparatus main body 12.

The light shielding part 96 is arranged at a left upper end portion of the actuator 92. The light shielding part 96 has a substantially plate shape extending in the upper-lower and left-right directions.

Figure 11A:
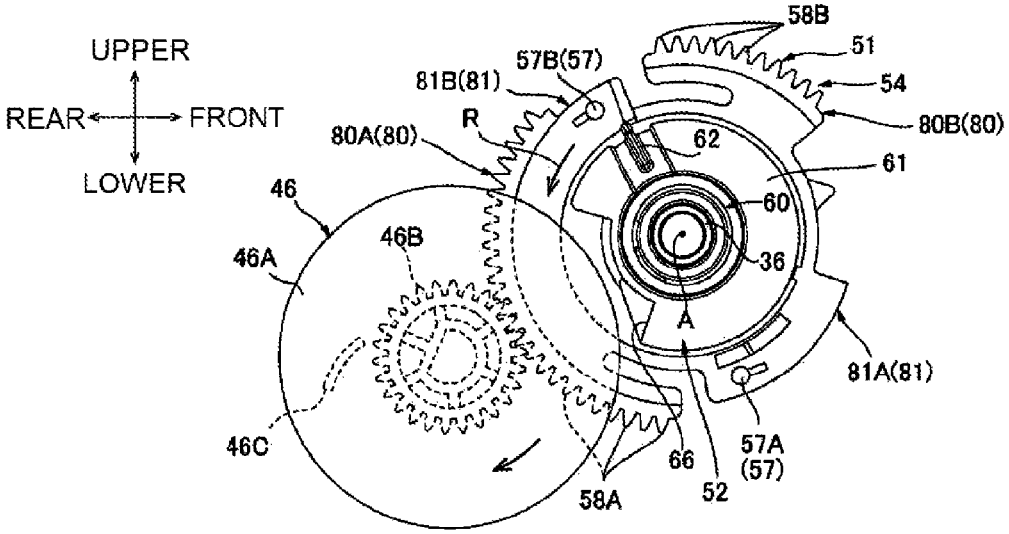
FIG. 11A illustrates the detection operation of the developing cartridge subsequent to FIG. 10B, illustrating a state where a first teeth part of the toothless gear is engaged with a second gear part of the agitator gear with the detection member being located at the advance position.
Figure 11B:
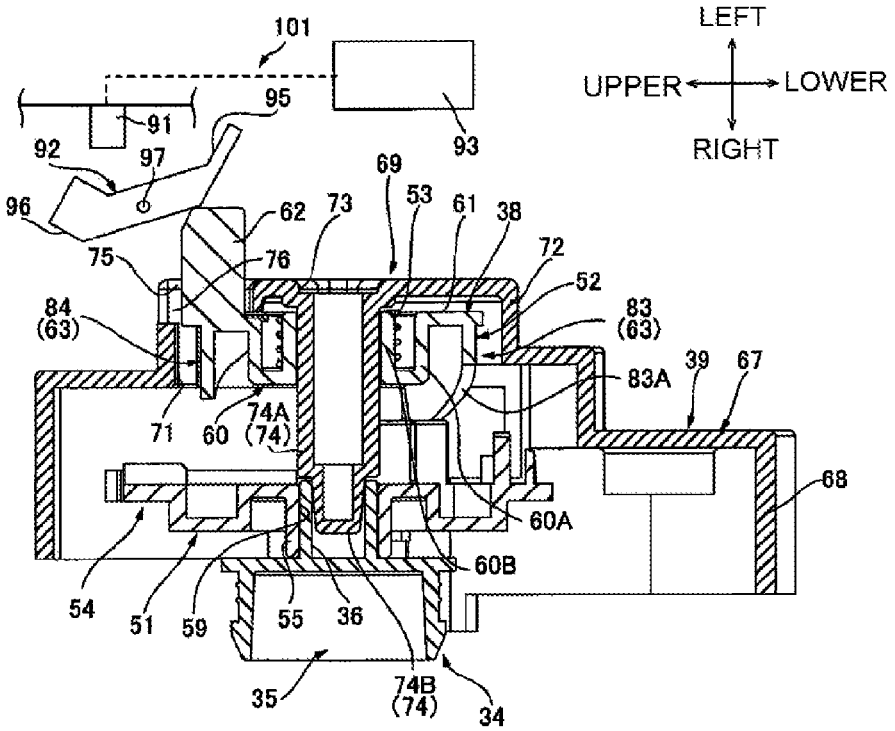
FIG. 11B is a sectional view of the detection unit and toothless gear shown in FIG. 11A corresponding to the A-A sectional view of FIG. 8A.

The light shielding part 96 is positioned between the light emitting device and light receiving device of the optical sensor 91 when the actuator 92 is located at the non-detection position, and is retreated rightward from between the light emitting device and light receiving device of the optical sensor 91 when the actuator 92 is located at the detection position (FIG. 11B). In the meantime, the actuator 92 is always urged towards the non-detection position by an urging member (not shown).

The control unit 93 has a circuit board having an application specific integrated circuit (ASIC) and is arranged in the apparatus main body 12. Also, the control unit 93 is configured to count the number of rotations of the developing roller 2.

5. Detection Operation

When the developing cartridge 1 is mounted to the apparatus main body 12 and the front cover 17 is closed, the right end portion of the main body coupling 100 is inserted into the space 48B of the coupling part 48 of the developing coupling 41, in accordance with the closing operation of the front cover 17, as shown in FIG. 1. At this time, each of the pair of engaging projections 100A faces each of the pair of protrusions 48A of the coupling part 48 in the circumferential direction of the coupling part 48.

After that, the control unit 93 starts a warm-up operation of the printer 11.

Then, the driving force from the driving source such as a motor (not shown) is transmitted, so that the main body coupling 100 is rotated in the clockwise direction, as seen from a left side. Thereby, the engaging projections 100A are respectively engaged with the corresponding protrusions 48A.

Then, the driving force is input from the apparatus main body 12 to the developing coupling 41 through the main body coupling 100, and the developing coupling 41 is rotated in the clockwise direction, as seen from the left side, as shown in FIG. 3A.

Thereby, the developing gear 42, the supply gear 43 and the idle gear 44 are rotated in the counterclockwise direction, as seen from the left side. Then, the developing roller 2 and the supply roller 3 are rotated in the counterclockwise direction, as seen from the left side, as shown in FIG. 2. Also, when the idle gear 44 is rotated, the agitator gear 46 is rotated in the clockwise direction, as seen from the left side, as shown in FIG. 3. Thereby, the agitator 6 is applied with the driving force from the developing coupling 41 and is thus rotated in the clockwise direction, as seen from the left side, as shown in FIG. 2.

Figure 10A:
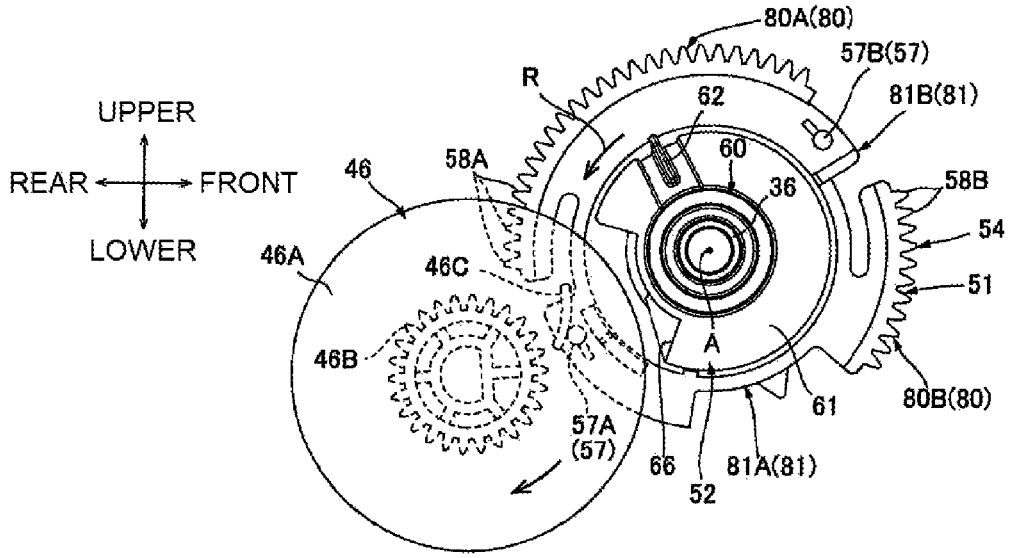
FIG. 10A illustrates a detection operation of the developing cartridge, illustrating a state where an abutting rib of the agitator gear abuts on a first boss of the toothless gear in the initial state.

When the agitator gear 46 is rotated, the abutting rib 46C contacts with the first boss 57A of the toothless gear 51 in the initial state, in accordance with the rotation of the agitator gear 46, as shown in FIG. 10A, thereby pressing the first boss 57A in a front-lower direction. Thereby, the toothless gear 51 is rotated from the initial state in the rotating direction R.

Figure 10B:
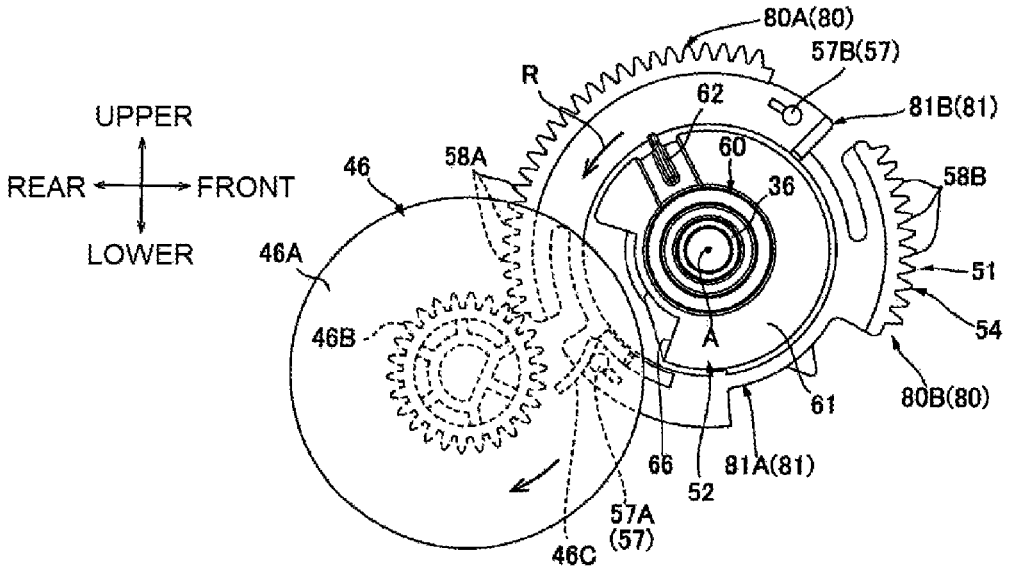
FIG. 10B illustrates the detection operation of the developing cartridge subsequent to FIG. 10A, illustrating a state where the toothless gear is being rotated from the initial state towards a primary driving state.

Thereby, as shown in FIG. 10B, the toothless gear 51 is engaged with the front upper end portion of the first gear part 46A of the agitator gear 46 at the gear teeth 58A of the downstream end portion of the first teeth part 80A in the counterclockwise direction. That is, the first teeth part 80A and the second gear part 46B face each other in the diametrical direction of the gear main body 54, and the first teeth part 80A and the second gear part 46B contact with each other. Thereby, the toothless gear 51 becomes a primary driving state, which is an example of the first state, and the driving force from the developing coupling 41 is transmitted through the idle gear 44 and the agitator gear 46.

Figure 12:
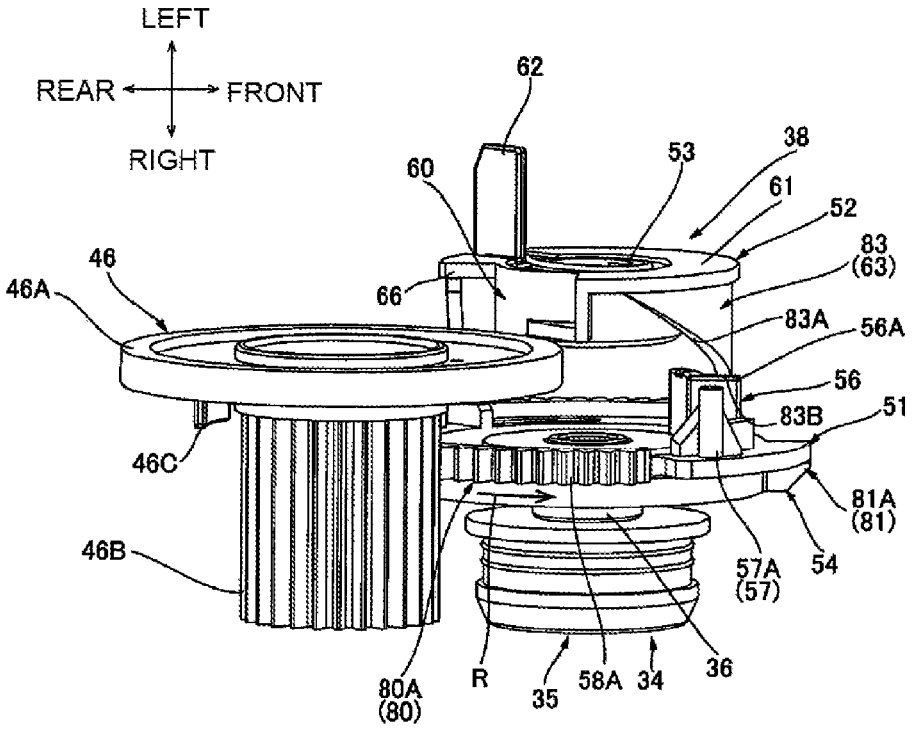
FIG. 12 is a perspective view of the detection unit, the toothless gear and the agitator gear shown in FIG. 11B, as seen from a left-lower side.

Then, the toothless gear 51 starts to rotate in the rotating direction R, and the slide rib 56 of the toothless gear 51 is moved in the rotating direction R, in accordance with the rotation of the toothless gear 51, as shown in FIGS. 9 and 12.

At this time, the free end portion 56A of the slide rib 56 presses leftward the first inclined surface 83A of the first displacement part 83 while sliding along the same in the rotating direction R. Thereby, the detection member 52 is gradually moved leftward from the retreat position against the urging force of the compression spring 63. Here, as described above, since the detection member 52 is restrained from moving relatively to the guide shaft 74, the detection member 52 is restrained from moving in the rotating direction R of the toothless gear 51.

That is, the toothless gear 51 is rotated, so that the detection member 52 is applied with the driving force from the toothless gear 51 and is thus moved leftward, and the detection projection 62 is moved leftward in accordance with the movement of the detection member 52.

Then, as shown in FIG. 11A, when the toothless gear 51 is further rotated, as the toothless gear 51 is rotated, the free end portion 56A of the slide rib 56 separates from the first inclined surface 83A and abuts on the first parallel surface 83B, as shown in FIG. 12.

At this time, as shown in FIG. 11B, the detection member 52 is arranged at an advance position at which it is advanced most leftward, against the urging force of the compression spring 53.

At the state where the detection member 52 is located at the advance position, the detection projection 62 is advanced more leftward than the closing wall 73 of the detection member accommodation part 69 through the slit 51, as shown in FIG. 3B. Then, as shown in FIG. 11B, the detection projection 62 abuts on the abutting part 95 of the actuator 92 from the right side, and presses leftward the abutting part 95. Thereby, the actuator 92 swings from the non-detection position in the counterclockwise direction, as seen from the rear side, and is thus located at the detection position.

At this time, the light shielding part 96 is retreated toward the right-upper side from between the light emitting device and the light receiving device of the optical sensor 91. Thereby, the light receiving device of the optical sensor 91 receives the detection light, and the optical sensor 91 outputs a light receiving signal.

Then, the control unit 93 determines that the new developing cartridge 1 has been mounted to the apparatus main body 12, because the light receiving signal is received from the optical sensor 91 within a predetermined time after the warm-up operation starts. Thereby, the control unit 93 resets the counted number of rotations of the developing roller 2.

Then, when the toothless gear 51 is further rotated, the free end portion 56A of the slide rib 56 separates from the first parallel surface 83B, abuts on the second inclined surface 83C, and slides along the second inclined surface 83C in the rotating direction R. At this time, the detection member 52 is gradually moved rightward by the urging force of the compression spring 63.

Then, the free end portion 56A of the slide rib 56 separates from the second inclined surface 83C, and is moved along the continuous surface 64A of the connection part 64, as shown in FIG. 14. At this time, as shown in FIG. 13B, the detection member 52 is located at a mid-position between the retreat position and the advance position in the left-right direction. The detection projection 62 of the detection member 52 located at the mid-position separates from the abutting part 95 of the actuator 92 and is thus spaced rightward from the abutting part 95.

Then, the actuator 92 swings from the detection position in the clockwise direction by an urging member (not shown), as seen from the rear side, and is thus returned to the non-detection position. Thereby, the light shielding part 96 of the actuator 92 is located between the light emitting device and the light receiving device of the optical sensor 91. Thus, the light receiving device of the optical sensor 91 does not receive the detection light and the optical sensor 91 stops the output of the first light receiving signal.

Figure 13A:
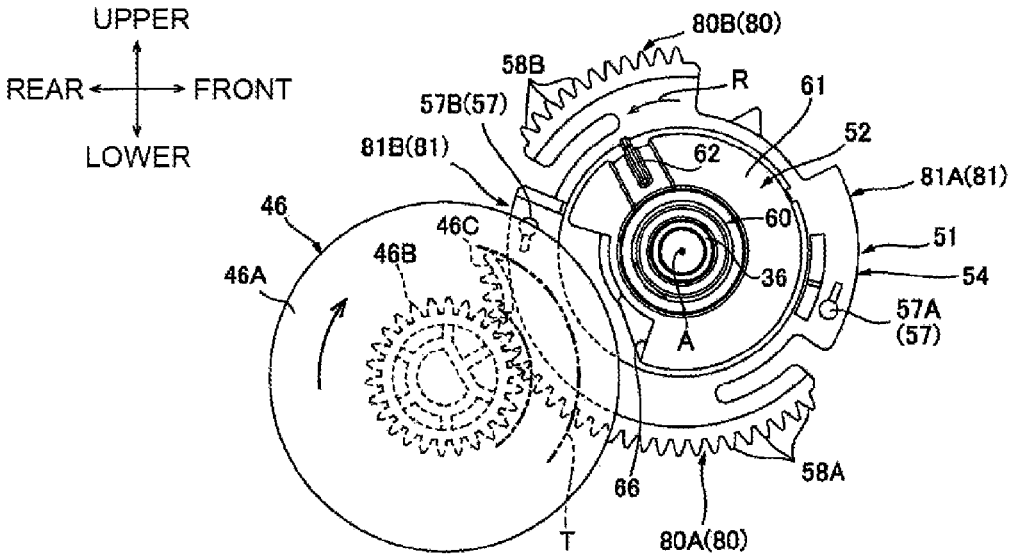
FIG. 13A illustrates the detection operation of the developing cartridge subsequent to FIG. 11A, illustrating a state just before the abutting rib of the agitator gear passes below a second boss of the toothless gear.
Figure 13B:
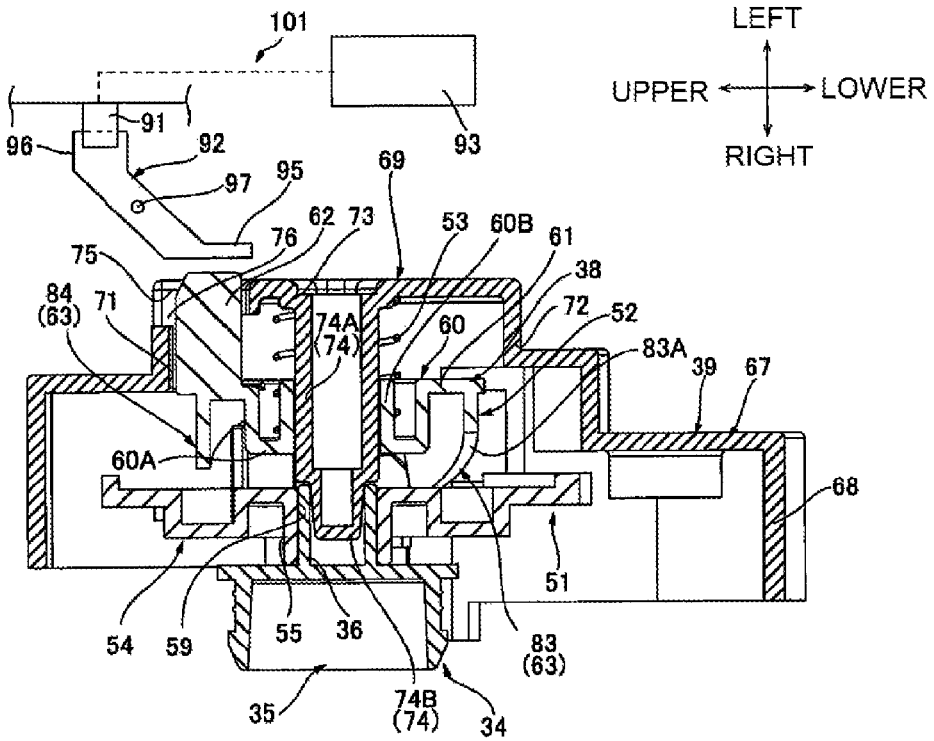
FIG. 13B is a sectional view of the detection unit and the toothless gear shown in FIG. 13A corresponding to the A-A sectional view of FIG. 8A.
Figure 15A:
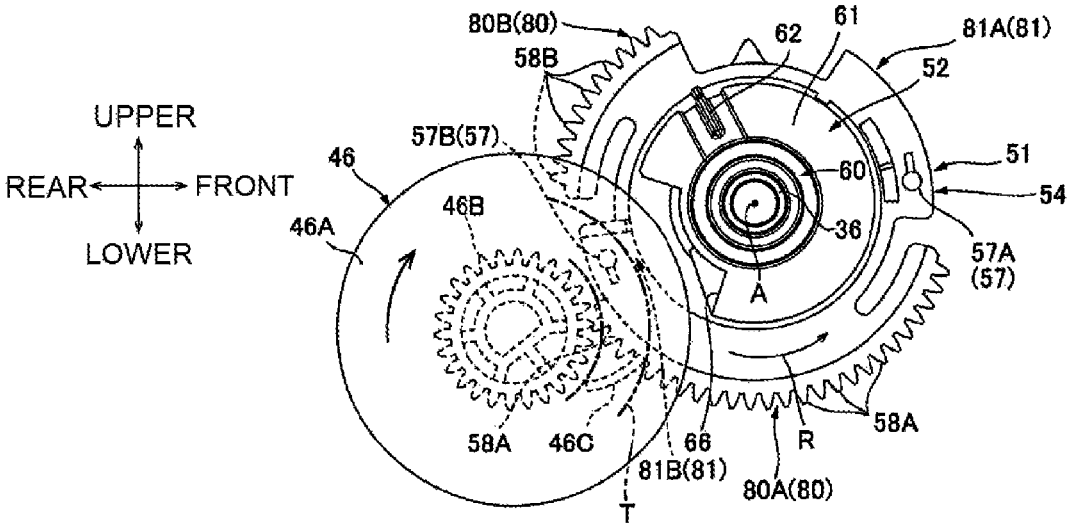
FIG. 15A illustrates the detection operation of the developing cartridge subsequent to FIG. 13A, illustrating a state where the toothless gear is being rotated from the primary driving state towards a stopped state.

Then, as shown in FIGS. 13A and 15A, when the toothless gear 51 is further rotated, the abutting rib 46C passes below the second boss 57B. At this time, the second boss 57B is positioned to overlap with the first gear part 46A in the left-right direction, and is also positioned at a more outer side of the second gear part 46B in the diametrical direction than a moving trajectory T of the abutting rib 46C moved in accordance with the rotation of the agitator gear 46. That is, the second boss 57B is positioned not to overlap with the moving trajectory T when the first teeth part 80A and the second gear part 46B contact with each other.

Figure 16A:
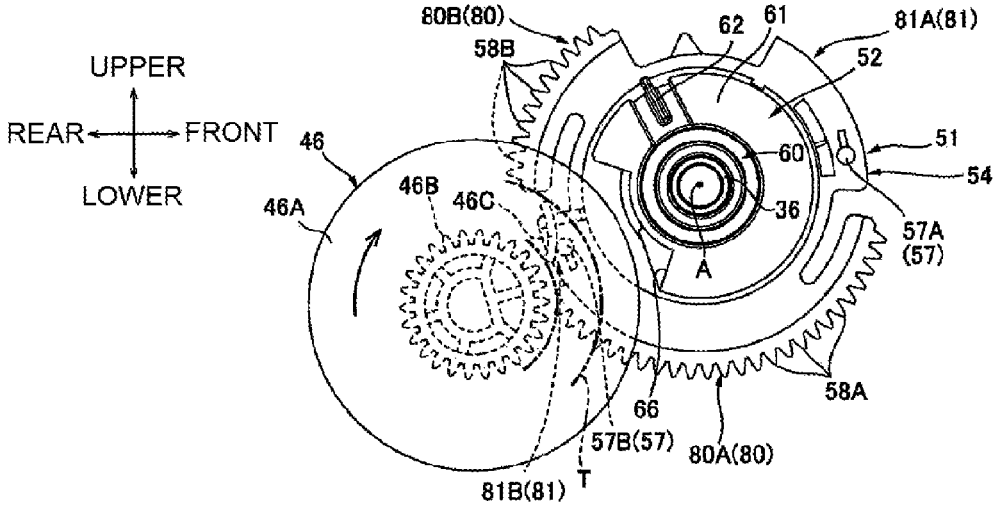
FIG. 16A illustrates the detection operation of the developing cartridge subsequent to FIG. 15A, illustrating a state where the abutting rib of the agitator gear abuts on the second boss of the toothless gear in the stopped state.

As shown in FIGS. 15A and 16A, the toothless gear 51 is rotated until the gear teeth 58A of the upstream end portion of the first teeth part 80A in the rotating direction R is spaced from the second gear part 46B of the agitator gear 46, and becomes a stopped state, which is an example of the second state, and then the rotation thereof is thus stopped. That is, the toothless gear 51 is temporarily stopped between the start of the rotation and the end of the rotation.

At this time, the second boss 57B enters the moving trajectory T from the outer side in the diametrical direction of the second gear part 46B at a timing at which the gear teeth 58A of the upstream end portion of the first teeth part 80A in the rotating direction R are spaced from the second gear part 46B. That is, the second boss 57B enters the moving trajectory T from the outside of the moving trajectory T at the time that the contact between the first teeth part 80A and the second gear part 46B is released.

Figure 15B:
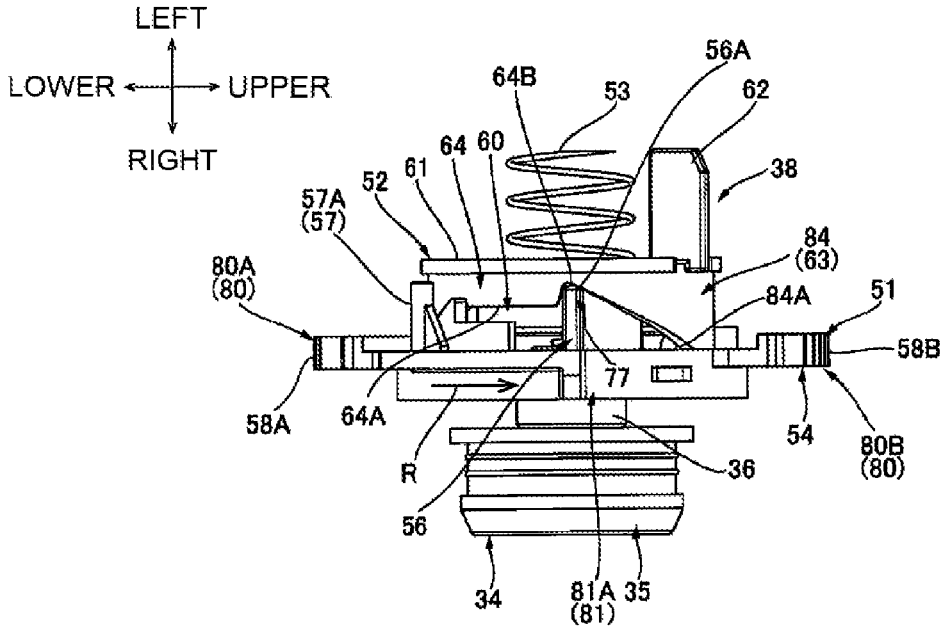
FIG. 15B is a front view of the detection unit, the toothless gear and the agitator gear shown in FIG. 15A.

Also, when the toothless gear 51 is switched from the primary driving state to the stopped state, the free end portion 56A of the slide rib 56 separates from the continuous surface 64A of the connection part 64, abuts on the notched surface 64B, and slides along the notched surface 64B in the rotating direction R, as shown in FIG. 15B. After that, the free end portion 56A of the slide rib 56 is fitted in the recess portion 77, which is a continuous part of the notched surface 64B and the third inclined surface 84A of the second displacement part 84. Thereby, the notched surface 64B of the connection part 64 contacts with the slide rib 56 of the toothless gear 51 from an upstream side in the rotating direction R, so that the toothless gear 51 is restrained from rotating from the stopped state towards an upstream side in the rotating direction R. Also, the third inclined surface 84A of the second displacement part 84 is arranged downstream from the slide rib 56 of the toothless gear 51 in the rotating direction R and restrains the toothless gear 51 from rotating from the stopped state towards a downstream side in the rotating direction R Then, as shown in FIG. 16A, when the toothless gear 51 is in the stopped state, the second toothless part 81B and the second gear part 46B face each other in the diametrical direction of the gear main body 54, and the toothless gear 51 is separated from the agitator gear 46 in the diametrical direction.

Figure 16B:
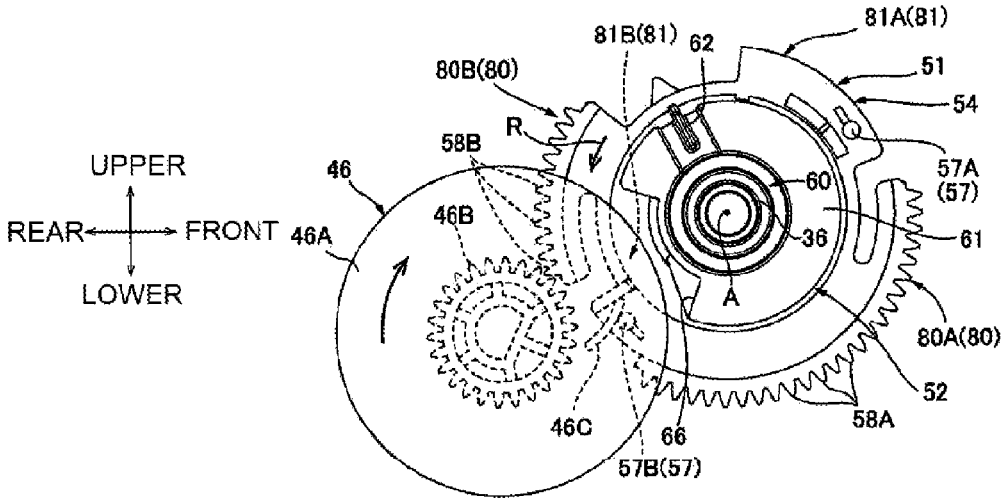
FIG. 16B illustrates the detection operation of the developing cartridge subsequent to FIG. 16A, illustrating a state where the toothless gear is being rotated from the stopped state towards a secondary driving state.

After that, when the toothless gear 51 is further rotated, the abutting rib 46C abuts on the second boss 57B of the toothless gear 51 in the stopped state, as shown in FIGS. 16A and 16B, thereby pressing the second boss 57B in a front-lower direction. Thereby, the toothless gear 51 is rotated from the stopped state in the rotating direction R, so that the gear teeth 58B of the downstream end portion of the second teeth part 80B in the rotating direction R are engaged with the front upper end portion of the first gear part 46A of the agitator gear 46. That is, the second teeth part 80B and the second gear part 46B face each other in the diametrical direction of the gear main body 54, and the second teeth part 80B and the second gear part 46B contact with each other. Thereby, the toothless gear 51 is switched from the stopped state to a secondary driving state, which is an example of the first state. That is, the toothless gear 51 is rotated from the primary driving state to the stopped state and is then rotated from the stopped state to the secondary driving state.

Figure 17A:
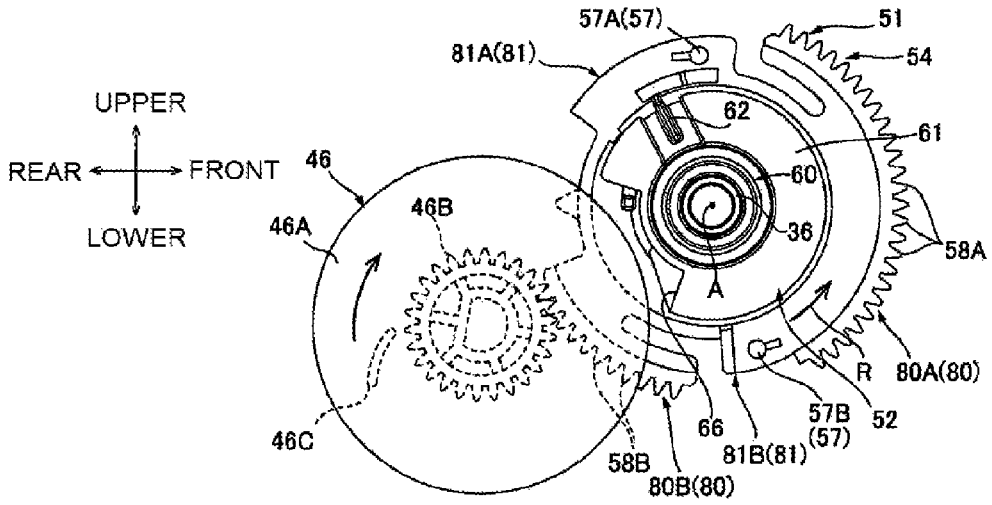
FIG. 17A illustrates the detection operation of the developing cartridge subsequent to FIG. 16B, illustrating a state where a second teeth part of the toothless gear is engaged with a second gear part of the agitator gear with the detection member being located at the advance position.

Then, as shown in FIG. 17A, the toothless gear 51 resumes rotating in the rotating direction R, and the free end portion 56A of the slide rib 56 sequentially friction-slides along the third inclined surface 84A and second parallel surface 84B of the second displacement part 84, like the first displacement part 83, thereby pressing leftward the detection member 52.

Figure 17B:
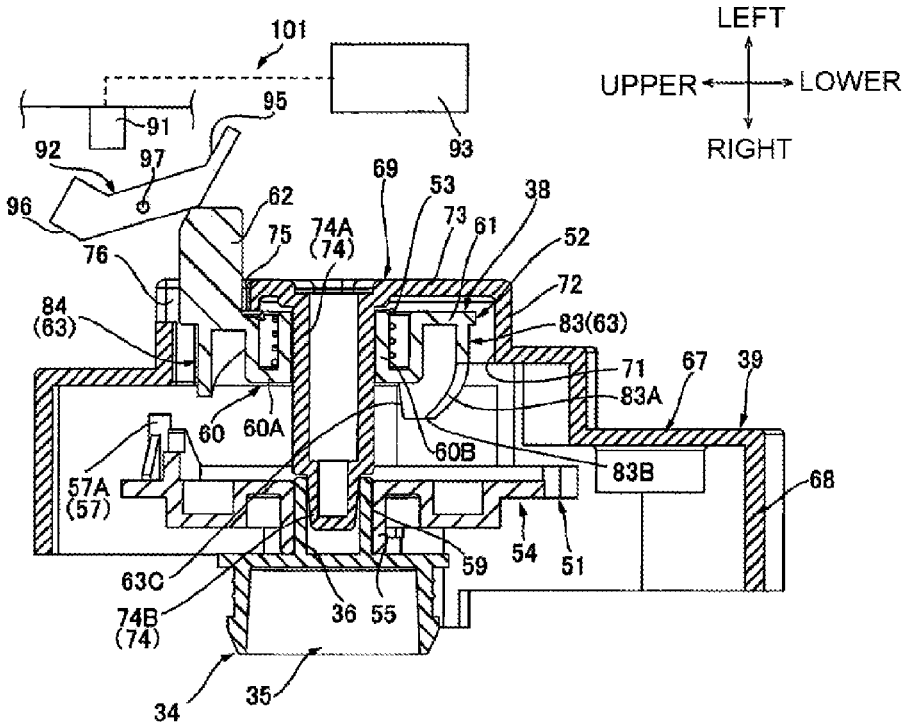
FIG. 17B is a sectional view of the detection unit and the toothless gear shown in FIG. 17A corresponding to the A-A sectional view of FIG. 8A.

Then, as shown in FIG. 17B, the detection member 52 is again located at the advance position, the detection projection 62 abuts on the abutting part 95 of the actuator 92. Thus, the actuator 92 swings from the non-detection position to the detection position. Thereby, the light receiving device of the optical sensor 91 again receives the detection light and the optical sensor 91 outputs a light receiving signal.

Then, as shown in FIG. 18A, when the toothless gear 51 is further rotated, the gear teeth 58B of the upstream end portion of the second teeth part 80B in the rotating direction R are spaced from the second gear part 46B of the agitator gear 46.

At this time, as shown in FIG. 18B, the free end portion 56A of the slide rib 56 separates from the second parallel surface 84B and abuts on the fourth inclined surface 84C. Thus, the detection member 52 is gradually moved rightward by the urging force of the compression spring 63.

Also, when the detection member 52 is gradually moved rightward, the free end portion 56A of the slide rib 56 is pressed in the rotating direction R by the fourth inclined surface 84C, so that the toothless gear 51 is further rotated in the rotating direction R.

The toothless gear 51 is stopped at a state where the downstream part of the first toothless part 81A in the rotating direction R faces the second gear part 46B of the agitator gear 46 in the diametrical direction of the gear main body 54 and the agitator gear 46 and the toothless gear 51 are spaced from each other. Thereby, the rotating operation of the toothless gear 51 is over, and the toothless gear 51 is in a terminal state, which is an example of the second state.

Figure 19A:
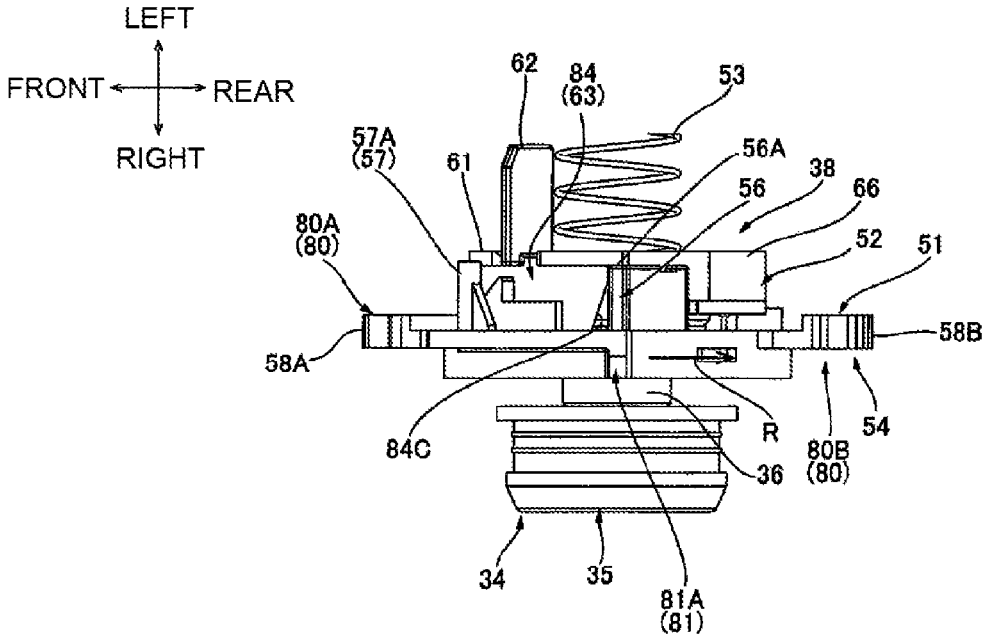
FIG. 19A is a perspective view of the detection unit, the toothless gear and the agitator gear, as seen from a rear-upper side, when the toothless gear reaches the terminal state, subsequently to FIG. 18B.

At this time, as shown in FIG. 19A, the slide rib 56 is close to the fourth inclined surface 84C of the second displacement part 84 at a downstream side in the rotating direction R. Thereby, the toothless gear 51 is restrained from rotating towards an upstream side in the rotating direction R. For this reason, the toothless gear 51 is maintained at the terminal state and keeps stopping, irrespective of the rotation of the agitator gear 46. That is, as shown in FIGS. 8A to 19A, the toothless gear 51 is irreversibly rotated in order of the initial state, the primary driving state, the stopped state, the secondary driving state and the terminal state.

Also, as shown in FIG. 19A, the free end portion 56A of the slide rib 56 abuts on the right surface of the collar part 61 at a more downstream side than the second displacement part 84 in the rotating direction R. For this reason, the detection member 52 is again located at the retreat position.

Figure 19B:
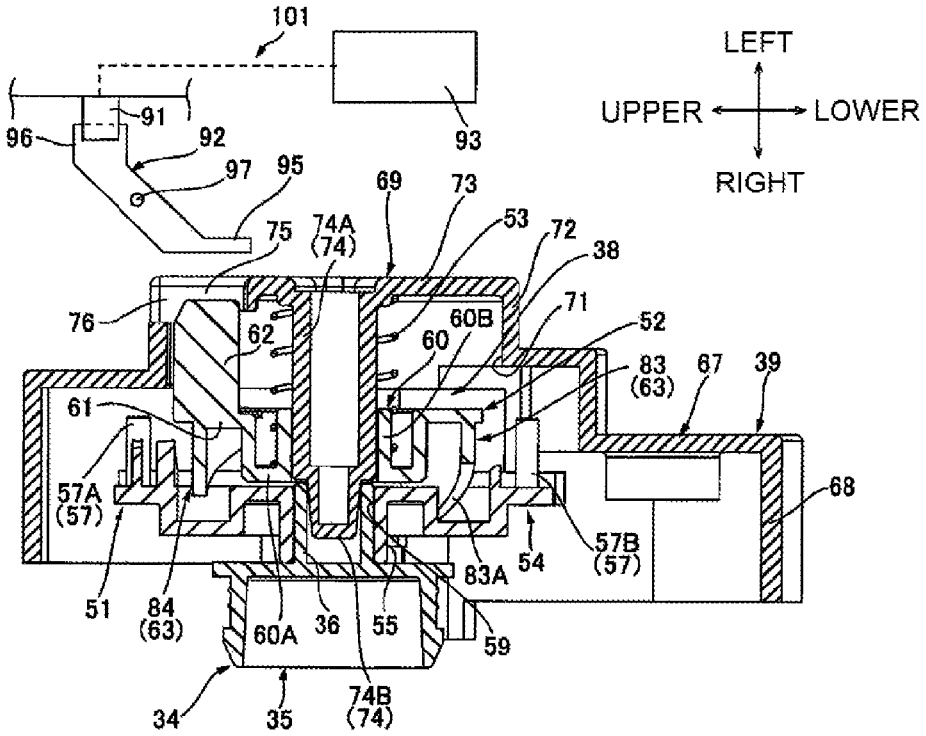
FIG. 19B is a sectional view of the detection unit and the toothless gear shown in FIG. 19A corresponding to the A-A sectional view of FIG. 8A.

Thereby, as shown in FIG. 19B, the abutting state between the abutting part 95 of the actuator 92 and the detection projection 62 is released, so that the actuator 92 is returned from the detection position to the non-detection position and the optical sensor 91 stops the output of the light receiving signal.

Thereafter, when the predetermined time elapses, the control unit 93 ends the warm-up operation.

Here, the number of receiving times of the light receiving signal and the interval of the light receiving signal, which is received from the optical sensor 91 by the control unit 93 within predetermined time after the warm-up operation starts, are associated with the specification (specifically, the maximum number of image formation sheets) of the developing cartridge 1.

For example, when the light receiving signal is received two times at a relatively short time interval, the control unit 93 determines that the developing cartridge 1 of a first specification (maximum number of image formation sheets: 6,000 sheets) has been mounted to the apparatus main body 12. Also, when the light receiving signal is received two times at a relatively long time interval, the control unit 93 determines that the developing cartridge 1 of a second specification (maximum number of image formation sheets: 3,000 sheets) has been mounted to the apparatus main body 12.

On the other hand, when the light receiving signal is not received from the optical sensor 91 within the predetermined time after the warm-up operation starts, the control unit 93 determines that the developing cartridge 1 used or being used has been mounted to the apparatus main body 12.

6. Operational Effects (1) As shown in FIG. 11A, in the primary driving state, the toothless gear 51 is rotated by the driving force transmitted from the developing coupling 41. After that, as shown in FIGS. 13A, 15A and 16A, the toothless gear 51 is rotated from the primary driving state to the stopped state, so that the transmission of the driving force from the developing coupling 41 is released. Thereby, the toothless gear 51 stops the rotation thereof. Subsequently, as shown in FIGS. 16B and 17A, the toothless gear 51 is rotated from the stopped state to the secondary driving state and is again rotated by the driving force transmitted from the developing coupling 41.

Therefore, as shown in FIGS. 11B, 13B and 17B, the detection projection 62 is moved, stopped and then again moved, in correspondence to the rotation, stop and re-rotation of the toothless gear 51.

For this reason, if the detection mechanism 101 is enabled to detect the movement of the detection projection 62, the detection mechanism 101 detects the detection projection 62, does not detect the detection projection 62 while the detection projection 62 is stopped after that, and again detects the detection projection 62 when the detection projection 62 is moved.

As a result, it is possible to enable the apparatus main body 12 to recognize that the unused developing cartridge 1 has been mounted.

(2) As shown in FIGS. 11A, 16A and 18A, the toothless gear 51 irreversibly rotates so as to rotate to the terminal state after rotating in an order of the primary driving state, the stopped state and the secondary driving state. For this reason, as shown in FIG. 19A, the toothless gear 51 is maintained at the stopped state after the operation thereof is over. As a result, it is possible to reduce the rotation of the detection projection 62 after the operation of the toothless gear 51 is over, and to reduce the undesirable detection of the detection projection 62 by the detection mechanism 101. Thereby, it is possible to reliably reduce a false detection.

(3) As shown in FIG. 1, the developing cartridge 1 includes the developing roller 2. For this reason, as shown in FIG. 2, the developing roller 2 can reliably supply the toner to the photosensitive drum 21.

(4) As shown in FIG. 11A, the agitator gear 46 transmits the driving force from the developing coupling 41 to the toothless gear 51. Therefore, it is possible to reliably transmit the driving force from the developing coupling 41 to the toothless gear 51 through the agitator gear 46.

(5) As shown in FIGS. 11A and 17A, when the toothless gear 51 is in the primary driving state and in the secondary driving state, respectively, the teeth part 80 faces the second gear part 46B of the agitator gear 46 in the diametrical direction and contacts with the second gear part 46B.

Also, as shown in FIGS. 8A and 16A, when the toothless gear 51 is in the initial state and the stopped state, respectively, the toothless part 81 faces the second gear part 46B of the agitator gear 46 in the diametrical direction and is spaced from the second gear part 46B in the diametrical direction.

For this reason, as shown in FIGS. 11A and 17A, when the toothless gear 51 is in the primary driving state and in the secondary driving state, the driving force from the developing coupling 41 is reliably transmitted, so that the toothless gear 51 is rotated. Further, as shown in FIGS. 8A and 16A, when the toothless gear 51 is in the initial state and the stopped state, the transmission of the driving force from the developing coupling 41 is reliably released, so that the rotation of the toothless gear 51 is stopped. As a result, it is possible to reliably rotate or stop the toothless gear 51.

Also, as shown in FIGS. 10A and 16A, the abutting rib 46C abuts on the boss 57 of the toothless gear 51 in the initial state or stopped state, thereby rotating the toothless gear 51 to the primary driving state or secondary driving state. For this reason, it is possible to rotate the toothless gear 51 from the initial state or stopped state to the primary driving state or secondary driving state at a desired timing, and to move the detection projection 62 at a desired timing.

(6) As shown in FIG. 8A, the plurality of toothless parts 81 is arranged at an interval in the rotating direction R. For this reason, it is possible to stop the toothless gear 51 a plurality of times and to stop the detection projection 62 a plurality of times.

Also, the bosses 57 are arranged to correspond to the plurality of toothless parts 81, respectively. For this reason, even when the toothless gear 51 is stopped a plurality of times, it is possible to rotate the toothless gear 51 again in each case.

(7) As shown in FIGS. 10A and 10B, when the toothless gear 51 is in the initial state, the first boss 57A is abutted on by the abutting rib 46C of the agitator gear 46 being rotated. Thereby, as shown in FIG. 10B, the toothless gear 51 in the initial state is rotated to the primary driving state, and the first teeth part 80A and the second gear part 46B of the agitator gear 46 contact with each other.

After that, as shown in FIGS. 11A and 16A, the toothless gear 51 is rotated until it is in the stopped state. Then, as shown in FIGS. 16A and 16B, the second boss 57B is abutted on by the abutting rib 46C of the agitator gear 46 being rotated, so that the toothless gear 51 is rotated from the stopped state to the secondary driving state and the second teeth part 80B and the second gear part 46B of the agitator gear 46 contact with each other.

For this reason, it is possible to reliably rotate the toothless gear 51 in an order of the initial state, the primary driving state, the stopped state and the secondary driving state.

(8) As shown in FIG. 13A, when the first teeth part 80A and the second gear part 46B of the agitator gear 46 contact with each other, i.e., when the toothless gear 51 is in the primary driving state, the second boss 57B is positioned not to overlap with the moving trajectory T of the abutting rib 46C. For this reason, when the toothless gear 51 is in the primary driving state, it is possible to reduce the abutting of the abutting rib 46C on the second boss 57B, so that it is possible to secure the smooth rotation of the toothless gear 51.

As shown in FIG. 15A, when the contact between the first teeth part 80A and the second gear part 46B of the agitator gear 46 is released, i.e., when the toothless gear 51 is rotated from the primary driving state to the stopped state, the second boss 57B enters the moving trajectory T of the abutting rib 46C from the outside of the moving trajectory T. For this reason, as shown in FIGS. 15A and 16A, it is possible to keep the toothless gear 51 at the stopped state after the second boss 57B enters the moving trajectory T and until the abutting rib 46C abuts on the second boss 57B.

After that, as shown in FIG. 16B, the abutting rib 46C abuts on the second boss 57B, so that the toothless gear 51 is rotated from the stopped state to the secondary driving state. For this reason, it is possible to further reliably rotate the toothless gear 51 from the primary driving state to the secondary driving state via the stopped state.

(9) As shown in FIG. 4A, the toothless gear 51 and the detection projection 62 are configured as separate members. For this reason, even when the toothless gear 51 is configured to rotate, it is possible to configure the detection projection 62 to be moved in a direction different from the rotating direction R of the toothless gear 51. As a result, it is possible to improve a degree of freedom of the arrangement of the detection projection 62, and to secure the effective arrangement of the toothless gear 51 and the detection projection 62.

(10) As shown in FIGS. 8B and 11B, the detection member 52 is applied with the driving force from the toothless gear 51 and is thus moved in the left-right direction. Therefore, the detection projection 62 is moved in the left-right direction in accordance with the movement of the detection member 52.

When the detection projection 62 is moved in the rotating direction R of the toothless gear 51, it is necessary to secure a space for the detection projection 62 to move around the rotational axis A of the toothless gear 51. For this reason, there is a limit in making the developing cartridge 1 small in the front-rear and upper-lower directions.

However, according to the developing cartridge 1, the detection projection 62 is moved in the left-right direction. Therefore, it is not necessary to secure a space for the detection projection 62 to move around the rotational axis A of the toothless gear 51. As a result, it is possible to effectively utilize the space around the rotational axis A of the toothless gear 51, and to make the developing cartridge 1 small in the front-rear and upper-lower directions.

(11) As shown in FIG. 9, the detection member 52 has the first inclined surface 83A. As the toothless gear 51 is rotated, the toothless gear 51 gradually presses leftward the first inclined surface 83A of the detection member 52. Thereby, it is possible to smoothly move the detection member 52 in the left-right direction.

(12) As shown in FIG. 8A, the detection member 52 has the notched portion 66 at the part overlapping with the first gear part 46A of the agitator gear 46 when seen in the left-right direction.

For this reason, upon the movement of the detection member 52, it is possible to reduce the interference between the detection member 52 and the agitator gear 46, as shown in FIG. 11B. Also, it is possible to reduce a space for arranging the detection member 52 and the agitator gear 46, so that it is possible to make the developing cartridge 1 smaller.

(13) As shown in FIG. 8B, the compression spring 53 urges the detection member 52 towards the developing frame 5. For this reason, it is possible to always position the detection member 52 in the vicinity of the developing frame 5 in the left-right direction. For this reason, for example, when the developing cartridge 1 is mounted to and demounted from the apparatus main body 12, it is possible to reduce the damage of the detection member 52, which is caused due to the interference with an external member.

(14) As shown in FIG. 15B, the detection member 52 has the connection part 64 having the notched surface 64B. The notched surface 64B contacts with the slide rib 56 of the toothless gear 51 in the stopped state, thereby restraining the toothless gear 51 from rotating upstream in the rotating direction R. Therefore, it is possible to reduce the rotation of the toothless gear 51 in the stopped state towards the upstream side in the rotating direction R.

(15) As shown in FIGS. 8B and 11B, the detection member 52 moves in the left-right direction while being restrained from moving in the rotating direction R. For this reason, the detection projection 62 also moves in the left-right direction while being restrained from moving in the rotating direction R.

As a result, it is possible to reduce a space for arranging the detection projection 62 in the rotating direction R. For this reason, it is possible to improve a degree of freedom of the arrangement of the detection projection 62 in the rotating direction R.

7. Modified Embodiments (1) First Modified Embodiment

Figure 20:
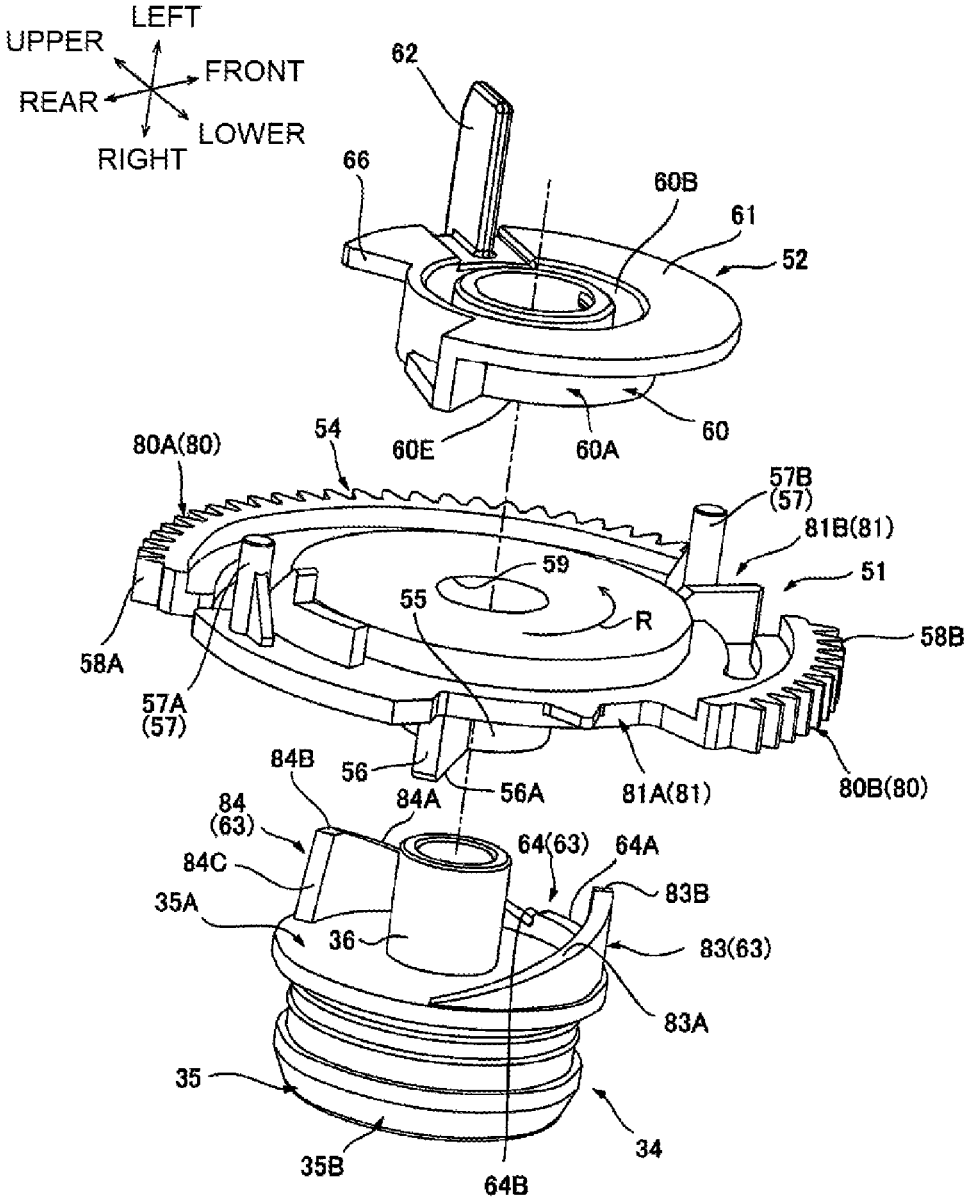
FIG. 20 is a perspective view of a toner cap, the toothless gear and the detection member according to a first modified embodiment of the disclosure.

In the above illustrative embodiment, as shown in FIGS. 6A and 6B, the detection member 52 has the displacement part 63. However, the disclosure is not limited thereto. For example, the displacement part 63 may be provided to the left sidewall 30. In this case, for example, as shown in FIG. 20, the toner cap 34 has the displacement part 63.

The displacement part 63 is arranged on the left surface of the closing part 35A. The displacement part 63 protrudes leftward from the left surface of the closing part 35A, and has the first displacement part 83, the connection part 64, and the second displacement part 84.

The first displacement part 83 has the first inclined surface 83A, the first parallel surface 83B, and the second inclined surface 83C. The first inclined surface 83A is inclined leftward toward the downstream side in the counterclockwise direction, as seen from the left side. The first parallel surface 83B continues from the first inclined surface 83A, and extends downstream in the counterclockwise direction, as seen from the left side. The second inclined surface 83C continues from the first parallel surface 83B and is inclined rightward towards the downstream side in the counterclockwise direction, as seen from the left side.

The connection part 64 has the continuous surface 64A, and the notched surface 64B. The continuous surface 64A continues from the left end portion of the second inclined surface 83C of the first displacement part 83, and extends downstream in the counterclockwise direction, as seen from the left side. The notched surface 64B continues from the continuous surface 64A and is inclined downstream in the counterclockwise direction toward the left side, as seen from the left side.

The second displacement part 84 has the third inclined surface 84A, the second parallel surface 84B, and the fourth inclined surface 84C. The third inclined surface 84A continues from the right end portion of the notched surface 64B of the connection part 64, and is inclined leftward toward the downstream side in the counterclockwise direction, as seen from the left side. The second parallel surface 84B continues from the third inclined surface 84A and extends downstream in the counterclockwise direction, as seen from the left side. The second inclined surface 83C continues from the second parallel surface 84B and is inclined rightward toward the downstream side in the counterclockwise direction, as seen from the left side.

Also, the slide rib 56 is arranged on the right surface of the first toothless part 81A of the gear main body 54. The slide rib 56 protrudes rightward from the right surface of the first toothless part 81A.

At the initial state of the toothless gear 51, the slide rib 56 is arranged at the rear of the first displacement part 83, and the free end portion 56A of the slide rib 56 contacts with the left surface of the closing part 35A at the rear of the first inclined surface 83A.

Also, the right wall 60E of the cylindrical part 60 of the detection member 52 contacts with the left surface of the gear main body 54 of the toothless gear 51. Thereby, in the above detection operation, it is possible to advance and retreat the detection projection 62 of the detection member 52 in the left-right direction.

(2) Second Modified Embodiment

Figure 21:
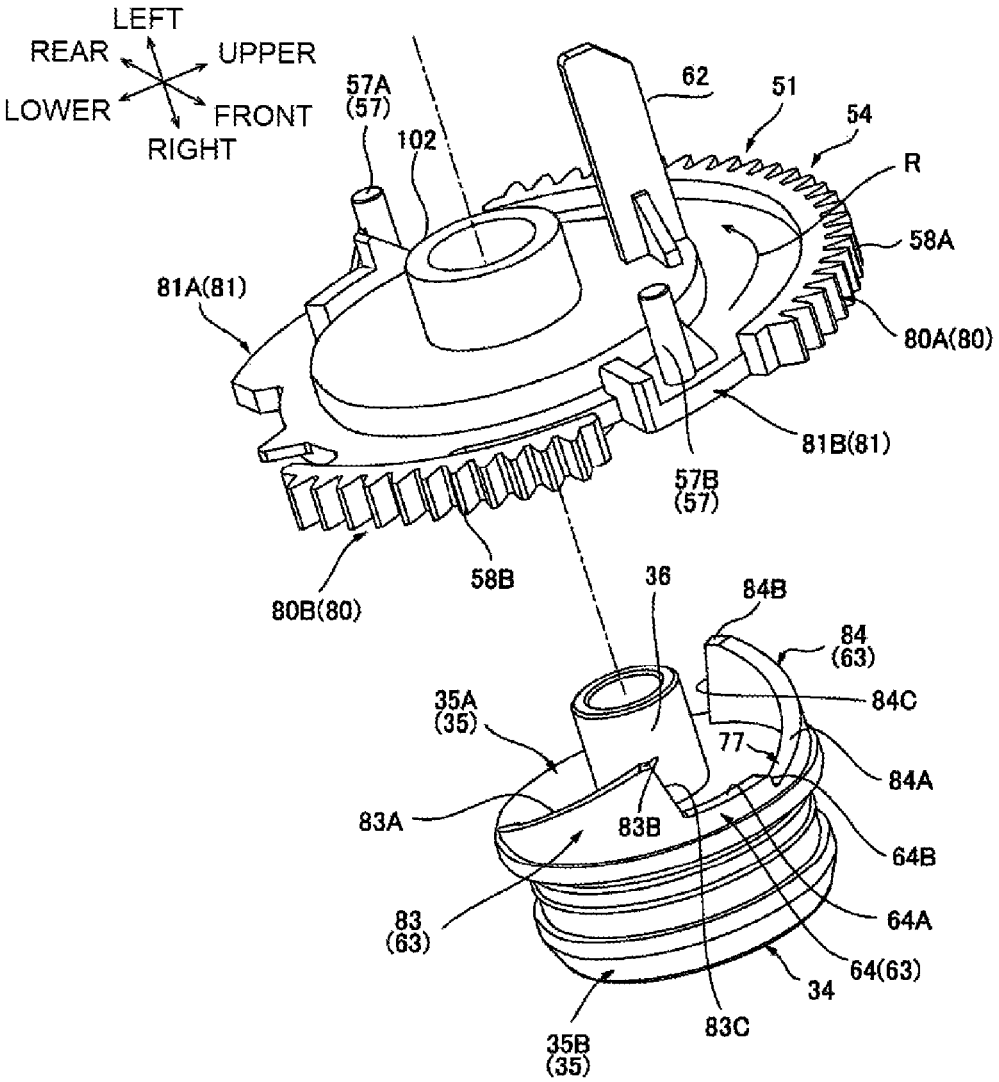
FIG. 21 is a perspective view of the toner cap and the detection member according to a second modified embodiment of the disclosure.

In the above illustrative embodiment, as shown in FIG. 4A, the detection projection 62 and the toothless gear 51 are configured as separate members. However, the disclosure is not limited thereto. For example, as shown in FIG. 21, the detection projection 62 and the toothless gear 51 may be integrally configured.

In this case, the toothless gear 51 integrally has the detection projection 62. Specifically, the detection projection 62 is arranged at a substantially center of the first teeth part 80A in the circumferential direction and at the substantially center of the first teeth part 80A in the diametrical direction on the left surface of the first teeth part 80A of the gear main body 54. The detection projection 62 has a substantially plate shape extending in the diametrical direction of the gear main body 54, and protrudes leftward from the left surface of the first teeth part 80A.

Also, the toothless gear 51 integrally has a cylindrical part 102. The cylindrical part 102 has a substantially cylindrical shape extending in the left-right direction, and protrudes leftward from the peripheral edge of the fitting hole 59 of the gear main body 54. An outer diameter of the cylindrical part 102 is substantially the same as the inner diameter of the compression spring 53. The cylindrical part 102 is inserted into the right end portion of the compression spring 53.

When the detection projection 62 and the toothless gear 51 are integrally configured, the toner cap 34 has the displacement part 63, like the first modified embodiment.

In the meantime, although not shown, the closing wall 73 of the gear cover 39 has an opening permitting the detection projection 62 to pass therethrough, in accordance with the rotation of the toothless gear 51.

Thereby, in the above detection operation, it is possible to advance and retreat the detection projection 62 in the left-right direction.

(3) Third Modified Embodiment

In the above illustrative embodiment, the toothless gear 51 has been exemplified as the rotary member, and the agitator gear 45 has been exemplified as the transmission member. However, the rotary member and the transmission member are not limited to the gear. For example, the rotary member and the transmission member may be configured by friction wheels having no gear teeth.

Figure 22:
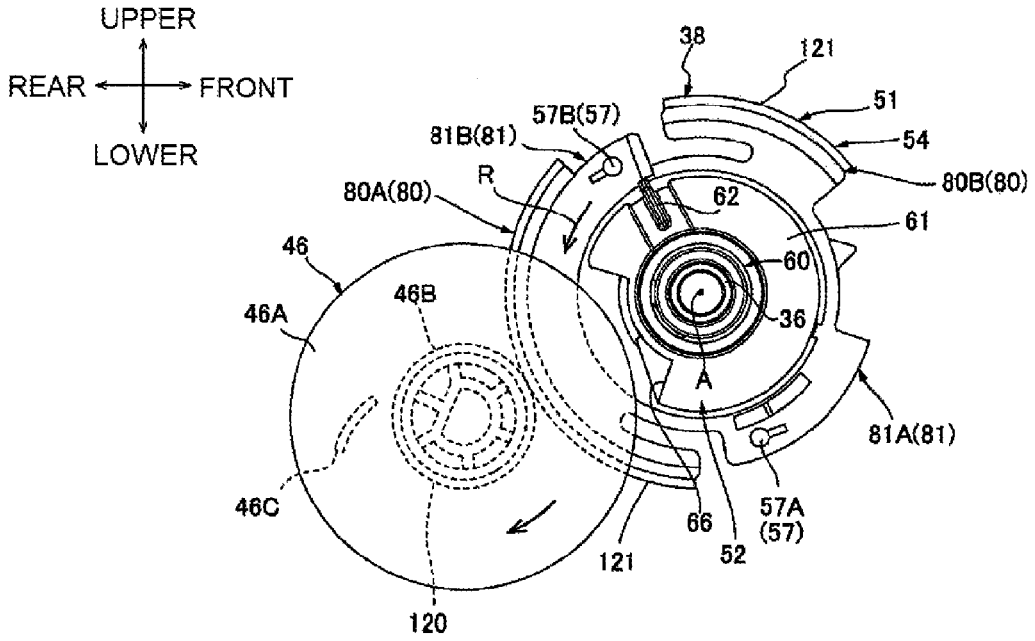
FIG. 22 is a left side view of the agitator gear and the detection unit according to a third modified embodiment of the disclosure.

Specifically, as shown in FIG. 22, the second gear part 46B of the agitator gear 46 may be provided with a first resistance applying member 120 of which at least an outer peripheral surface is configured by a material having a relatively large friction coefficient such as rubber, instead of the gear teeth, the teeth part 80 of the toothless gear 51 may be provided with a second resistance applying member 121 of which at least an outer peripheral surface is configured by a material having a relatively large friction coefficient such as rubber, instead of the gear teeth, and the driving force may be transmitted through friction between the resistance applying members.

Also, in this case, the second gear part 46B of the agitator gear 46 may be configured to have the gear teeth and only the teeth part 80 of the toothless gear 51 may be provided with the second resistance applying member 121 of which the outer peripheral surface is configured by the material having a relatively large friction coefficient such as rubber.

(4) Fourth Modified Embodiment

Figure 23A:
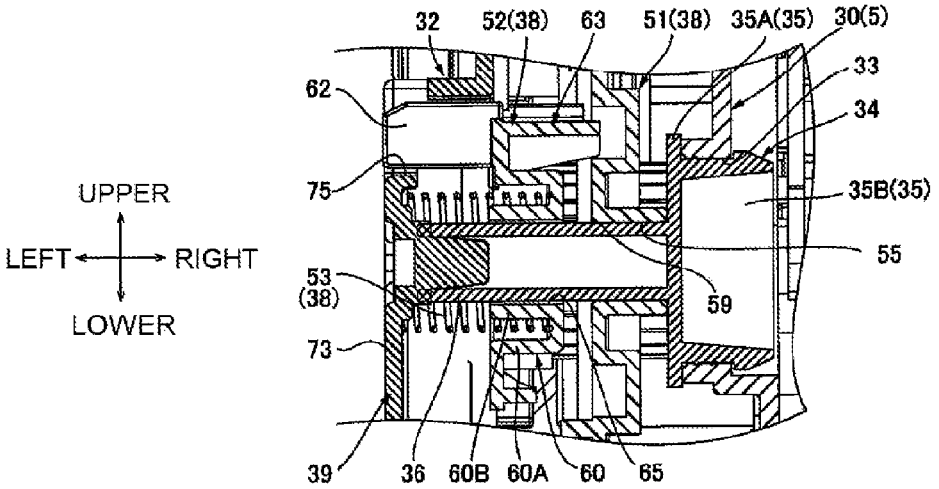
FIG. 23A is a sectional view of the detection unit and the toner cap according to a fourth modified embodiment of the disclosure.

In the above illustrative embodiment, as shown in FIG. 8B, the support shaft 36 of the toner cap 34 is configured to support the toothless gear 51, and the guide shaft 74 of the gear cover 39 is configured to support the detection member 52, as shown in FIG. 8B. However, as shown in FIG. 23A, the gear cover 39 may not be provided with the guide shaft 74 and the support shaft 36 of the toner cap 34 may be elongated in the left-right direction to support the toothless gear 51 and the detection member 52.

(5) Fifth Modified Embodiment

Figure 23B:
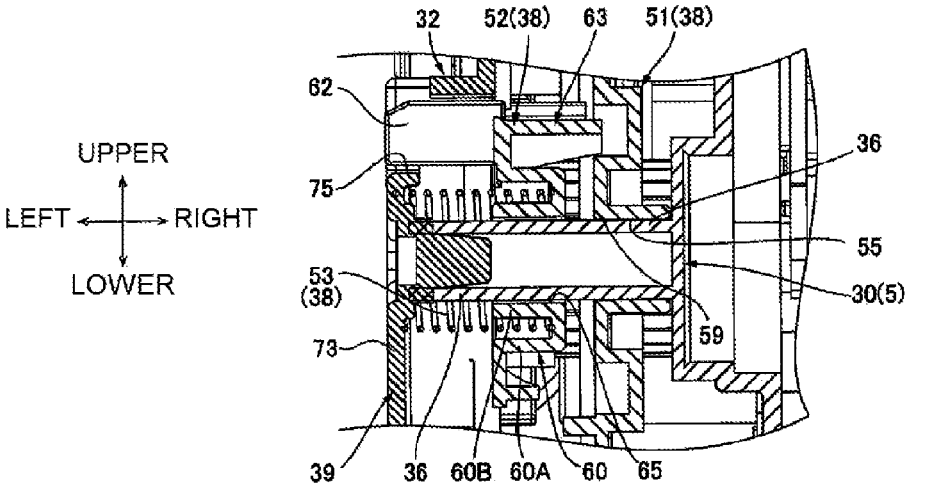
FIG. 23B is a sectional view of the detection unit and the toner cap according to a fifth modified embodiment of the disclosure.

In the fourth modified embodiment, the toner cap 34 is provided with the support shaft 36. However, as shown in FIG. 23B, the support shaft 36 may be provided integrally with the left sidewall 30 of the developing frame 5.

(6) Sixth Modified Embodiment

Figure 23C:
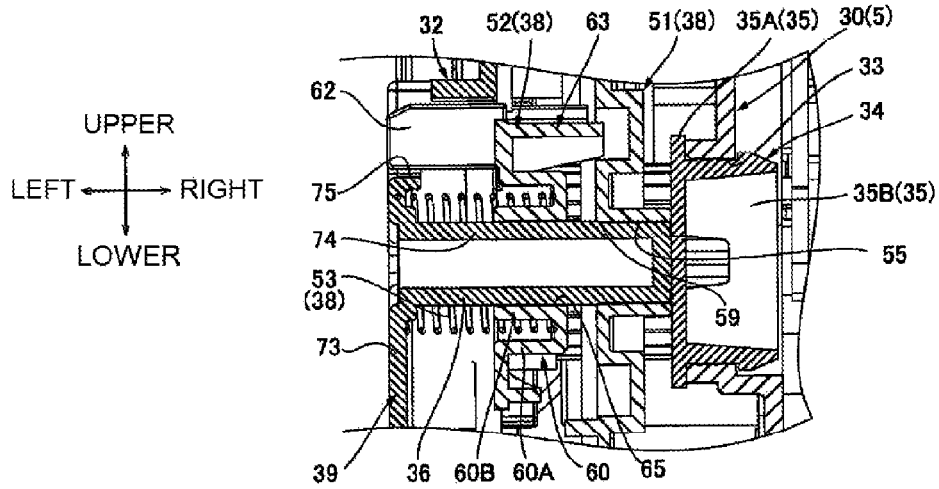
FIG. 23C is a sectional view of the detection unit and the toner cap according to a sixth modified embodiment of the disclosure.

Also, as shown in FIG. 23C, the toner cap 34 may not be provided with the support shaft 36 and the guide shaft 74 of the gear cover 39 may be elongated in the left-right direction to support the toothless gear 51 and the detection member 52.

Also, in this case, the guide shaft 74 provided for the gear cover 39 may be supported with the left sidewall 30 of the developing frame 5, instead of the toner cap 34.

(7) Seventh Modified Embodiment

In the above illustrative embodiment, as shown in FIGS. 6A and 6B, the displacement part 63 is provided to the detection member 52. However, the disclosure is not limited thereto. For example, the displacement part 63 may be provided to the toothless gear 51.

In this case, the displacement part 63 is arranged on the left surface of the gear main body 54, and the detection member 52 has the slide rib 56.

The displacement part 63 is arranged on the left surface of the gear main body 54. On the left surface of the displacement part 63, the first incline surface 83A, the first parallel surface 83B, the second inclined surface 83C, the continuous surface 64A, the notched surface 64B, the third inclined surface 84A, the second parallel surface 84B and the fourth inclined surface 84C are arranged in this order from an upstream side towards a downstream side in the rotating direction R.

The first inclined surface 83A is inclined rightward towards the downstream side in the rotating direction R. The first parallel surface 83B continues from the first inclined surface 83A and extends upstream in the rotating direction R. The second inclined surface 83C continues from the first parallel surface 83B and is inclined rightward towards the upstream side in the rotating direction R.

The continuous surface 64A continues from the second inclined surface 83C and extends upstream in the rotating direction R. The notched surface 64B continues from the continuous surface 64A and is inclined upstream in the rotating direction R toward the right side.

The third inclined surface 84A continues from the notched surface 64B, and is inclined leftward toward the upstream side in the rotating direction R. The second parallel surface 84B continues from the third inclined surface 84A and extends upstream in the rotating direction R. The fourth inclined surface 84C continues from the second parallel surface 84B, and is inclined rightward toward the upstream side in the rotating direction R.

The slide rib 56 is arranged on the right surface of the collar part 61 of the detection member 52. The slide rib 56 protrudes rightward from right surface of the collar part 61. At the initial state of the toothless gear 51, the slide rib 56 is arranged at the front of the first displacement part 83, and the free end portion 56A of the slide rib 56 contacts with the left surface of the gear main body 54 in front of the first inclined surface 83A.

In the above detection operation, as the toothless gear 51 is rotated, the first inclined surface 83A of the toothless gear 51 gradually presses leftward the detection member 52. For this reason, it is possible to smoothly move the detection member 52 in the left-right direction.

(8) Eighth Modified Embodiment

In the above illustrative embodiment, as shown in FIGS. 6A and 6B, the detection member 52 has the first displacement part 83 and the second displacement part 84, and is configured to be located at the advance position two times during the detection operation. However, the number of times that the detection member 52 is located at the advance position is not particularly limited. For example, the detection member 52 may be configured to be located at the advance position three times during the detection operation. In this case, although not shown, the displacement part 63 of the detection member 52 further has a third displacement part having the same configuration as the first displacement part 83.

In the eighth modified embodiment, the detection projection 62 of the detection member 52 abuts on the abutting part 95 of the actuator 92 three times, thereby positioning the actuator 92 at the detection position three times. As a result, the control unit 93 receives the light receiving signal from the optical sensor 91 three times.

In this way, when the light receiving signal is received three times, the control unit 93 determines that the developing cartridge 1 of a third specification (maximum number of image formation sheets: 12,000 sheets) has been mounted to the apparatus main body 12. In the meantime, the relation between the specification of the developing cartridge 1 and the number of times that the detection member 52 is located at the advance position can be appropriately changed.

Also, the numerical values of the maximum number of image formation sheets of the respective specifications of the developing cartridge 1 (for example, the first specification: 6,000 sheets, the second specification: 3,000 sheet and the third specification: 12,000 sheets) may be appropriately changed to other values (for example, 1,500 sheets, 5,000 sheets and the like)

(9) Other Modified Embodiments

In the above illustrative embodiment, as shown in FIGS. 5A and 5B, the gear main body 54 has the two toothless parts 81. However, the number of the toothless parts 81 is not particularly limited.

For example, when increasing the number of the toothless parts 81, it is possible to stop the toothless gear 51 more than once in the above detection operation. Thereby, it is possible to appropriately change an interval between the plurality of light receiving signals received by the control unit 93. For this reason, it is possible increase the specification of the developing cartridge 1 by changing the interval between the plurality of light receiving signals.

Also, in the above illustrative embodiment, the detection projection 62 is advanced and retreated in the left-right direction by the rotation of the toothless gear 51. However, the disclosure is not limited thereto. For example, it is only necessary that the detection projection 62 is moved by the rotation of the toothless gear 51, and need not necessarily be advanced and retreated in the left-right direction.

For example, the detection projection 62 may be configured to move in the circumferential direction of the toothless gear 51, in accordance with the rotation of the toothless gear 51. In this case, the detection projection 62 is arranged on the left surface of the gear main body 54 of the toothless gear 51. Also, each of the toothless gear 51 and the toner cap 34 does not have the displacement part 63 and the slide rib 56, respectively.

Also, in the above illustrative embodiment, as shown in FIG. 2, the developing cartridge 1 is configured to be mounted to or demounted from the drum cartridge 20. However, the disclosure is not limited thereto. For example, the developing cartridge 1 may be configured integrally with the drum cartridge 20. In this case, the process cartridge 13 integrally having the developing cartridge 1 and the drum cartridge 20 corresponds to an example of the cartridge.

Also, only the developing cartridge 1 may be configured to be mounted to or demounted from the apparatus main body 12 having the photosensitive drum 21.

Also, the developing cartridge 1 may be configured so that a toner cartridge accommodating therein the toner is mounted to or demounted from the frame having the developing roller 2. In this case, the toner cartridge has the driving unit 32 except for the developing gear 42 and the supply gear 43, and corresponds to an example of the cartridge.

Further, only such toner cartridge may be configured to be mounted to or demounted from the apparatus main body 12 having the developing roller 2 and the photosensitive drum 21.

Also, in the above illustrative embodiment, as shown in FIGS. 6A and 6B, the detection member 52 is made of a well-known plastic and integrally has the detection projection 62. However, the disclosure is not limited thereto. For example, the detection member 52 may have the detection projection 62 as a separate member. In this case, the detection projection 62 is made of an elastic member such as resin film and rubber, for example.

In the above illustrative embodiment, the agitator gear 46 has the abutting rib 46C and the toothless gear 51 has the bosses 57. However, the disclosure is not limited thereto. For example, the agitator gear 46 may have the bosses 57 and the toothless gear 51 may have the abutting rib 46C.

In the above illustrative embodiment, the developing roller 2 corresponds to an example of the developer carrier. However, for example, a developing sleeve, a brush-shaped roller and the like may also be applied, instead of the developing roller 2.

In the above illustrative embodiment, the detection member 52 is advanced from the retreat position to the advance position, is retreated from the advance position to the mid-position and is then advanced from the mid-position to the advance position.

That is, the movement distance of the detection member 52 during the second and thereafter advancing operations is shorter than the movement distance of the detection member 52 during the first advancing operation. However, the movement distances of the detection member 52 during the respective advancing operations may be the same or may be all different.

Also, during one advancing and retreating operation, the movement amount of the detection member 52 during the advancing operation and the movement amount of the detection member 52 during the retreating operation may be different.

In the above illustrative embodiment, the detection projection 62 is completely accommodated in the gear cover 39 at the state where the detection member 52 is located at the retreat position. However, the detection projection 62 may slightly protrude from the gear cover 39 at the state where the detection member 52 is located at the retreat position.

In the above illustrative embodiment, the pair of sidewalls 30 of the developing frame 5 extends in the front-rear direction, respectively. However, at least one of the pair of sidewalls 30 may extend in a direction inclined relative to the front-rear direction.

In the above illustrative embodiment, the idle gear support shaft 31 is integrally provided for the sidewall 30 of the developing frame 5. However, the idle gear support shaft 31 may be configured as a separate member from the developing frame 5.

In the above illustrative embodiment, the support shaft (not shown) configured to support the developing coupling 41 is integrally provided for the sidewall 30 of the developing frame 5. However, the support shaft (not shown) configured to support the developing coupling 41 may be a separate member from the developing frame 5.

Also in the above modified embodiments, it is possible to accomplish the same operational effects as the illustrative embodiment. The above illustrative embodiment and modified embodiments may be combined with each other.

The disclosure provides illustrative, non-limiting aspects as follows:

According to an aspect of the disclosure, there is provided a cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to rotate from a first state where the driving force from the driving receiving part is transmitted to the rotary member to a second state where the transmission of the driving force from the driving receiving part to the rotary member is released, and then rotate from the second state to the first state.

According to the above configuration, in the first state, the rotary member is rotated by the driving force transmitted from the driving receiving part. After that, the rotary member is rotated from the first state to the second state, so that the transmission of the driving force from the driving receiving part is released. Thereby, the rotary member stops the rotation thereof. Subsequently, the rotary member is rotated from the second state to the first state and is again rotated by the driving force transmitted from the driving receiving part.

The detected part is moved by the rotation of the rotary member. Therefore, the detected part is moved, stopped and then again moved, in correspondence to the rotation, stop and re-rotation of the rotary member.

For this reason, if an external device is enabled to detect the movement of the detected part, the external device detects the detected part, does not detect the detected part while the detected part is stopped after that, and again detects the detected part when the detected part is moved.

As a result, it is possible to enable the external device to recognize that the unused cartridge has been mounted.

In the above cartridge, the rotary member may be configured to irreversibly rotate so as to rotate to the second state after at least rotating in an order of the first state, the second state and the first state.

According to the above configuration, the rotary member irreversibly rotates so as to rotate to the second state after at least rotating in an order of the first state, the second state and the first state. For this reason, the rotary member is maintained at a stopped state after the operation thereof is over. As a result, it is possible to reduce the movement of the detected part after the operation of the rotary member is over, and to reduce the undesirable detection of the detected part by the external device. Thereby, it is possible to reliably reduce a false detection when the used cartridge has been mounted.

The above cartridge may further include a developer carrier configured to carry thereon the developer.

According to the above configuration, the developer carrier can reliably supply the developer to an external photosensitive member.

The above cartridge may further include a transmission member configured to rotate by receiving the driving force from the driving receiving part and transmit the driving force from the driving receiving part to the rotary member. In the above cartridge, the rotary member may be configured to rotate by receiving the driving force from the transmission member.

According to the above configuration, the transmission member transmits the driving force from the driving receiving part to the rotary member. Therefore, it is possible to reliably transmit the driving force from the driving receiving part to the rotary member through the transmission member.

In the above cartridge, the transmission member may include an engaging part. The rotary member may include: a contact part, in the first state, facing the transmission member in a diametrical direction of the rotary member and contact the transmission member, a separation part, in the second state, facing the transmission member in the diametrical direction and separate from the transmission member in the diametrical direction, and an engaged part, in the second state, being abutted on by the engaging part of the transmission member being rotated to thus rotate the rotary member to the first state.

According to the above configuration, when the rotary member is in the first state, the contact part faces the transmission member in the diametrical direction and contacts the transmission member, and when the rotary member is in the second state, the separation part faces the transmission member in the diametrical direction and is spaced from the transmission member in the diametrical direction.

For this reason, when the rotary member is in the first state, the driving force from the driving receiving part is reliably transmitted, so that the rotary member is rotated. Further, when the rotary member is in the second state, the transmission of the driving force from the driving receiving part is reliably released, so that the rotation of the rotary member is stopped. As a result, it is possible to reliably rotate or stop the rotary member.

Also, the engaging part abuts on the engaged part of the rotary member in the second state, thereby rotating the rotary member to the first state. For this reason, it is possible to rotate the rotary member from the second state to the first state at a desired timing, and to move the detected part at a desired timing.

In the above cartridge, when the contact part and the transmission member contact with each other, the engaged part may be positioned not to overlap with a moving trajectory of the engaging part in accordance with the rotation of the transmission member. When the contact between the contact part and the transmission member is released, the engaged part may be configured to enter the moving trajectory from an outside of the moving trajectory.

According to the above configuration, when the contact part and the transmission member contact with each other, i.e., when the rotary member is in the first state, the engaged part is positioned not to overlap with the moving trajectory of the engaging part in accordance with the rotation of the transmission member. For this reason, when the rotary member is being rotated, it is possible to reduce the abutting of the engaging part on the engaged part. As a result, it is possible to secure the smooth rotation of the rotary member.

When the contact between the contact part and the transmission member is released, i.e., when the rotary member is rotated from the first state to the second state, the engaged part enters the moving trajectory of the engaging part from the outside of the moving trajectory. For this reason, it is possible to keep the rotary member at the second state after the engaged part enters the moving trajectory and until the engaging part abuts on the engaged part.

After that, the engaging part abuts on the engaged part, so that the rotary member is rotated from the second state to the first state.

For this reason, it is possible to reliably rotate the rotary member from the first state to the first state via the second state.

In the above cartridge, a plurality of the separation parts may be arranged at an interval in a rotating direction of the rotary member. A plurality of the engaged parts may be arranged to correspond to each of the plurality of the separation parts, respectively.

According to the above configuration, since the plurality of the separation parts is arranged at an interval in the rotating direction, it is possible to position the rotary member in the second state a plurality of times. For this reason, it is possible to stop the detected part a plurality of times.

Also, since the engaged parts are arranged to correspond to the plurality of the separation parts, respectively, even when the rotary member is in the second state a plurality of times, it is possible to rotate the rotary member in the second state to the first state in each case.

In the above cartridge, the contact part may include: a first contact part, and a second contact part arranged at an interval from the first contact part at an upstream side in the rotating direction. The separation part may include: a first separation part arranged downstream from the first contact part in the rotating direction, and a second separation part arranged between the first contact part and the second contact part in the rotating direction. The engaged part may include: a first engaged part corresponding to the first separation part, and a second engaged part corresponding to the second separation part and arranged at an interval from the first engaged part at an upstream side in the rotating direction. When the first separation part and the transmission member face each other in the diametrical direction and the rotary member is positioned in the second state, the first engaged part may be abutted on by the engaging part of the transmission member being rotated to thus rotate the rotary member from the second state to the first state, thereby bringing the first contact part and the transmission member into contact with each other. When the second separation part and the transmission member face each other in the diametrical direction and the rotary member is positioned in the second state, the second engaged part may be abutted on by the engaging part of the transmission member being rotated to thus rotate the rotary member from the second state to the first state, thereby bringing the second contact part and the transmission member into contact with each other.

According to the above configuration, when the first separation part and the transmission member face each other in the diametrical direction and the rotary member is positioned in the second state, the first engaged part is abutted on by the engaging part of the transmission member being rotated. Thereby, the rotary member in the second state is rotated to the first state and the first contact part and the transmission member contact with each other.

After that, the rotary member is rotated until the contact between the first contact part and the transmission member is released and the second separation part and the transmission member face each other in the diametrical direction. Thereby, the rotary member is again positioned in the second state.

Then, the second engaged part is abutted on by the engaging part of the transmission member being rotated, so that the rotary member is rotated from the second state to the first state and the second contact part and the transmission member contacts with each other.

For this reason, it is possible to reliably rotate the rotary member in an order of the second state, the first state, the second state and the first state.

In the above cartridge, when the first contact part and the transmission member contact with each other, the second engaged part may be positioned not to overlap with the moving trajectory of the engaging part in accordance with the rotation of the transmission member. When the contact between the first contact part and the transmission member is released, the second engaged part may be configured to enter the moving trajectory from an outside of the moving trajectory.

According to the above configuration, when the first contact part and the transmission member contact with each other, i.e., when the rotary member is in the first state, the second engaged part is positioned not to overlap with the moving trajectory of the engaging part in accordance with the rotation of the transmission member. For this reason, when the rotary member is in the first state, it is possible to reduce the abutting of the engaging part on the second engaged part, so that it is possible to secure the smooth rotation of the rotary member.

When the contact between the first contact part and the transmission member is released, i.e., when the rotary member is rotated from the first state to the second state, the second engaged part enters the moving trajectory of the engaging part from the outside of the moving trajectory. For this reason, it is possible to keep the rotary member at the second state after the second engaged part enters the moving trajectory and until the engaging part abuts on the second engaged part.

After that, the engaging part abuts on the second engaged part, so that the rotary member is rotated from the second state to the first state.

For this reason, it is possible to further reliably rotate the rotary member from the first state to the first state via the second state.

In the above cartridge, the rotary member and the detected part may be configured as separate members.

According to the above configuration, the rotary member and the detected part are configured as separate members. For this reason, even when the rotary member is configured to rotate, it is possible to configure the detected part to be moved in a direction different from the rotating direction of the rotary member. As a result, it is possible to improve a degree of freedom of the arrangement of the detected part, and to secure the effective arrangement of the rotary member and the detected part.

The above cartridge may further include: a detected member including the detected part and configured to move in an axis direction parallel with a rotational axis of the rotary member by receiving the driving force from the rotary member.

According to the above configuration, the detected member is applied with the driving force from the rotary member and is thus moved in the axis direction. Therefore, the detected part is moved in the axis direction in accordance with the movement of the detected member.

When the detected part is moved in the rotating direction of the rotary member, it is necessary to secure a space for the detected part to move around a rotational axis of the rotary member. For this reason, there is a limit in making the cartridge small in a direction orthogonal to the axis direction.

However, according to the above configuration, the detected part is moved in the axis direction. Therefore, it is not necessary to secure a space for the detected part to move around the rotational axis of the rotary member.

As a result, it is possible to effectively utilize the space around the rotational axis of the rotary member, and to make the cartridge small in the direction orthogonal to the axis direction.

In the above cartridge, the detected member may be arranged at an opposite side of the housing with respect to the rotary member. One of the rotary member and the detected member may have an inclined surface that faces an other of the rotary member and the detected member in the axis direction and is configured to friction-slide on the other of the rotary member and the detected member when the rotary member is rotated. The inclined surface may be inclined to become closer to the rotary member towards a downstream side of the rotary member in the rotating direction.

According to the above configuration, when the rotary member has the inclined surface, as the rotary member is rotated, the inclined surface of the rotary member gradually presses the detected member in the axis direction.

Also, when the detected member has the inclined surface, as the rotary member is rotated, the rotary member gradually presses the inclined surface of the detected member in the axis direction.

Thereby, it is possible to smoothly move the detected member in the axis direction by the inclined surface provided to one of the rotary member and the detected member.

In the above cartridge, a portion of the detected member, which overlaps with the transmission member when seen in the axis direction, may be notched.

According to the above configuration, upon the movement of the detected member, it is possible to reduce the interference between the detected member and the transmission member. Also, it is possible to reduce a space for arranging the detected member and the transmission member, so that it is possible to make the cartridge smaller.

The above cartridge may further include: an urging member arranged at an opposite side of the housing with respect to the detected member and urging the detected member towards the housing in the axis direction.

According to the above configuration, since the urging member urges the detected member towards the housing, it is possible to always position the detected member in the vicinity of the housing in the axis direction. For this reason, for example, when the cartridge is mounted to and demounted from the apparatus main body, it is possible to reduce the damage of the detected member, which is caused due to the interference with an external member.

In the above cartridge, the detected member may have a restraint part configured to restrain rotation of the rotary member by being engaged with the rotary member in the second state.

According to the above configuration, the restraint part restrains the rotation of the rotary member by being engaged with the rotary member in the second state. Therefore, it is possible to reduce the rotation of the rotary member in the second state at an undesired timing.

In the above cartridge, the detected part may be configured to move while being restrained from moving in the rotating direction of the rotary member.

According to the above configuration, since the detected part moves while being restrained from moving in the rotating direction, it is possible to reduce a space for arranging the detected part in the rotating direction. For this reason, it is possible to improve a degree of freedom of the arrangement of the detected part in the rotating direction.

In the above cartridge, the detected part may be configured to move from a first position to a second position when the rotary member is rotated in the first state.

According to another aspect of the disclosure, there is provided a cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to temporarily stop between a start of the rotation and an end of the rotation.

According to the above configuration, the rotary member is temporarily stopped between the start of the rotation and the end of the rotation. Further, the detected part is moved by the rotation of the rotary member. Therefore, the detected part is moved, stopped and then again moved, in correspondence to the operations of the rotary member where the rotary member starts the rotation, is temporarily stopped, and is then rotated until the rotation is over.

For this reason, if an external device is enabled to detect the movement of the detected part, the external device detects the detected part, does not detect the detected part while the detected part is stopped after that, and again detects the detected part when the detected part is moved.

As a result, it is possible to enable the external device to recognize that the unused cartridge has been mounted.

According to another aspect of the disclosure, there is provided a cartridge including: a housing configured to accommodate therein developer; a driving receiving part configured to receive a driving force; a rotary member configured to rotate by receiving a driving force from the driving receiving part, and a detected part configured to be moved by the rotation of the rotary member, wherein the rotary member is configured to start the rotation by the driving force transmitted from the driving receiving part, stop the rotation after the starting of the rotation, and resume the rotation after the stopping of the rotation.

According to the above configuration, the rotary member start the rotation by the driving force transmitted from the driving receiving part, stop the rotation after the starting of the rotation, and resumes the rotation after the stopping of the rotation. The detected part is moved by the rotation of the rotary member. Therefore, the detected part is moved, stopped and then again moved, in correspondence to the rotation, stop and re-rotation of the rotary member.

For this reason, if an external device is enabled to detect the movement of the detected part, the external device detects the detected part, does not detect the detected part while the detected part is stopped after that, and again detects the detected part when the detected part is moved.

As a result, it is possible to enable the external device to recognize that the unused cartridge has been mounted.

What is claimed is:

1. A cartridge comprising:

a housing configured to accommodate therein developer;

a driving receiving part configured to receive a driving force;

a transmission gear configured to rotate about a rotational axis by receiving the driving force from the driving receiving part;

a toothless gear configured to be engaged with the transmission gear, the toothless gear being configured to rotate about a rotational axis by receiving a driving force from the transmission gear, the toothless gear including:

a first teeth part;

a second teeth part; and a first toothless part arranged between the first teeth part and the second teeth part in a rotational direction of the toothless gear; and a detected part configured to be moved by rotation of the toothless gear, wherein the toothless gear is configured to rotate from a first state to a second state in accordance with rotation of the transmission gear, wherein the toothless gear is configured to rotate from the second state to a third state in accordance with rotation of the transmission gear, the first state being a state where the first teeth part of the toothless gear is engaged with the transmission gear and the driving force from the driving receiving part is transmitted to the toothless gear, the second state being a state where the first toothless part of the toothless gear faces the transmission gear and the transmission of the driving force from the driving receiving part to the toothless gear is released, and the third state being a state where the second teeth part of the toothless gear is engaged with the transmission gear and the driving force from the driving receiving part is transmitted to the toothless gear.

2. The cartridge according to claim 1, wherein the toothless gear is configured to irreversibly rotate about the rotational axis of the toothless gear.

3. The cartridge according to claim 1, wherein the transmission gear includes an engaging part, and wherein the toothless gear includes:

a first engaged part, in the second state, being abutted on by the engaging part of the transmission gear being rotated to thus rotate the toothless gear to the third state.

4. The cartridge according to claim 3, wherein, when the first teeth part is engaged with the transmission gear, the first engaged part is positioned not to overlap with a moving trajectory of the engaging part in accordance with rotation of the transmission gear, and wherein, when the engagement between the first teeth part and the transmission gear is released, the first engaged part is configured to enter the moving trajectory from an outside of the moving trajectory.

5. The cartridge according to claim 3, wherein the toothless gear includes a second toothless part, the first teeth part being arranged between the first toothless part and the second toothless part in a rotational direction of the toothless gear, and wherein the toothless gear includes a second engaged part, the first engaged part being arranged to correspond to the first toothless part, the second engaged part being arranged to correspond to the second toothless part.

6. The cartridge according to claim 3, wherein the toothless gear is movable from a fourth state to the first state in accordance with rotation of the transmission gear, the fourth state being a state where the second toothless part of the toothless gear faces the transmission gear, wherein, when the toothless gear is positioned in the fourth state, the second engaged part is abutted on by the engaging part of the transmission gear being rotated to thus rotate the toothless gear from the fourth state to the first state.

7. The cartridge according to claim 1, wherein the toothless gear and the detected part are configured as separate members.

8. The cartridge according to claim 7, further comprising:

a detected member including the detected part and configured to move in an axis direction along the rotational axis of the toothless gear by receiving the driving force from the toothless gear.

9. The cartridge according to claim 8, wherein the detected member is arranged at an opposite side of the housing with respect to the toothless gear, wherein one of the toothless gear and the detected member has an inclined surface that faces an other of the toothless gear and the detected member in the axis direction and is configured to friction-slide on the other of the toothless gear and the detected member when the toothless gear is rotated, and wherein the inclined surface is inclined to become closer to the toothless gear towards a downstream side of the toothless gear in the rotating direction.

10. The cartridge according to claim 9, wherein a portion of the detected member, which overlaps with the transmission gear when seen in the axis direction, is notched.

11. The cartridge according to claim 9, further comprising:

an urging member arranged at an opposite side of the housing with respect to the detected member and urging the detected member towards the housing in the axis direction.

12. The cartridge according to claim 9, wherein the detected member has a restraint part configured to restrain rotation of the toothless gear by being engaged with the toothless gear in the second state.

13. The cartridge according to claim 1, wherein the detected part is configured to move while being restrained from moving in the rotating direction of the toothless gear.

14. A cartridge comprising:

a housing configured to accommodate developer;

a coupling rotatable about a rotational axis;

a transmission gear rotatable about a rotational axis in accordance with rotation of the coupling, a toothless gear configured to be engaged with the transmission gear, the toothless gear being rotatable about a rotational axis in accordance with rotation of the transmission gear, the toothless gear including:

a first teeth part configured to be engaged with the transmission gear;

a second teeth part configured to be engaged with the transmission gear; and a first toothless part arranged between the first teeth part and the second teeth part in a rotational direction of the toothless gear; and a detected part movable in accordance with rotation of the toothless gear, wherein the toothless gear is rotatable from a first state to a second state in accordance with rotation of the transmission gear, wherein the toothless gear is rotatable from the second state to a third state in accordance with rotation of the transmission gear, the first state being a state where the first teeth part of the toothless gear is engaged with the transmission gear, the second state being a state where the first toothless part of the toothless gear faces the transmission gear, the third state being a state where the second teeth part of the toothless gear is engaged with the transmission gear.

15. The cartridge according to claim 14, wherein the toothless gear is configured to irreversibly rotate about the rotational axis of the toothless gear.

16. The cartridge according to claim 14, wherein the transmission gear includes a first protrusion, wherein the toothless gear includes a second protrusion, and wherein, when toothless gear is positioned in the second state, the first protrusion of the transmission gear abuts on the second protrusion in accordance with rotation of the transmission gear to rotate the toothless gear from the second state to the third state.

17. The cartridge according to claim 16, wherein the toothless gear includes a second toothless part, the first teeth part being arranged between the first toothless part and the second toothless part in a rotational direction of the toothless gear, and wherein the toothless gear includes a third protrusion, the second protrusion being arranged to correspond to the first toothless part, the third protrusion being arranged to correspond to the second toothless part.

18. The cartridge according to claim 17, wherein the toothless gear includes:

a first surface facing an outer surface of the housing in an axis direction along the rotational axis; and a second surface opposite to the first surface in the axis direction;

wherein the transmission gear includes a third surface facing the second surface of the toothless gear in the axis direction, wherein the first protrusion protrudes from the third surface of the transmission gear in the axis direction, wherein the second protrusion protrudes from the second surface of the toothless gear in the axis direction, and wherein the third protrusion protrudes from the second surface of the toothless gear in the axis direction.

19. The cartridge according to claim 17, wherein the toothless gear is movable from a fourth state to the first state in accordance with rotation of the transmission gear, the fourth state being a state where the second toothless part of the toothless gear faces the transmission gear, wherein, when the toothless gear is positioned in the fourth state, the first protrusion of the transmission gear abuts on the third protrusion in accordance with rotation of the transmission gear to rotate the toothless gear from the fourth state to the first state.

20. The cartridge according to claim 16, wherein the toothless gear includes:

a first surface facing an outer surface of the housing in an axis direction along the rotational axis; and a second surface opposite to the first surface in the axis direction;

wherein the transmission gear includes a third surface facing the second surface of the toothless gear in the axis direction, wherein the first protrusion protrudes from the third surface of the transmission gear in the axis direction, and wherein the second protrusion protrudes from the second surface of the toothless gear in the axis direction.

21. The cartridge according to claim 16, wherein, when the first teeth part is engaged with the transmission gear, the second protrusion is positioned not to overlap with a moving trajectory of the first protrusion in accordance with rotation of the transmission gear, and wherein, when the engagement between the first teeth part and the transmission gear is released, the second protrusion is configured to enter the moving trajectory from an outside of the moving trajectory.

22. The cartridge according to claim 14, wherein the toothless gear and the detected part are as separate members.

23. The cartridge according to claim 22, further comprising:

a detected member including the detected part and configured to move in an axis direction along the rotational axis of the toothless gear in accordance with rotation of the toothless gear.

24. The cartridge according to claim 23, wherein the toothless gear includes:

a first surface facing an outer surface of the housing in the axis direction;

a second surface opposite to the first surface in the axis direction;

wherein the detected member includes a third surface facing the second surface of the toothless gear in the axis direction, wherein the detected member has an inclined surface protruding from the third surface towards the toothless gear in the axis direction, and wherein the inclined surface slides on the toothless gear when the toothless gear is rotated.

25. The cartridge according to claim 24, further comprising:

an urging member urging the detected member towards the housing in the axis direction.

26. The cartridge according to claim 24, wherein the detected member has a restraint part configured to restrain rotation of the toothless gear by being engaged with the toothless gear, when the toothless gear is positioned in the second state.

27. The cartridge according to claim 14, wherein the detected part is configured to move while the detected part is restrained from moving in a rotating direction of the toothless gear.

* * * * *